US010530067B2

(12) United States Patent
Horibe et al.

(10) Patent No.: US 10,530,067 B2
(45) Date of Patent: Jan. 7, 2020

(54) ANTENNA ELEMENT, ANTENNA UNIT AND COMMUNICATION MODULE

(71) Applicant: Murata Manufacturing Co., Ltd., Nagaokakyo-shi, Kyoto-fu (JP)

(72) Inventors: Takayuki Horibe, Nagaokakyo (JP); Nobumitsu Amachi, Nagaokakyo (JP); Masayuki Kobayashi, Nagaokakyo (JP); Masahiro Izawa, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 55 days.

(21) Appl. No.: 16/003,141

(22) Filed: Jun. 8, 2018

(65) Prior Publication Data

US 2018/0294580 A1 Oct. 11, 2018

Related U.S. Application Data

(63) Continuation of application No. PCT/JP2016/079033, filed on Sep. 30, 2016.

(30) Foreign Application Priority Data

Dec. 24, 2015 (JP) ..... 2015-252525

(51) Int. Cl.

| | |
|---|---|
| ***H01Q 1/38*** | (2006.01) |
| ***H01Q 21/30*** | (2006.01) |
| ***H01Q 9/26*** | (2006.01) |
| *H01Q 1/48* | (2006.01) |

(52) U.S. Cl.

CPC ..... *H01Q 21/30* (2013.01); *H01Q 1/38* (2013.01); *H01Q 9/26* (2013.01); *H01Q 1/48* (2013.01)

(58) Field of Classification Search

CPC ..... H01Q 21/30; H01Q 1/38; H01Q 9/26; H01Q 1/48

See application file for complete search history.

(56) References Cited

U.S. PATENT DOCUMENTS

2013/0171951 A1 7/2013 Li et al.

FOREIGN PATENT DOCUMENTS

| | | | |
|---|---|---|---|
| JP | 2001-332924 | A | 11/2001 |
| JP | 2005-045599 | A | 2/2005 |
| JP | 2006-222850 | A | 8/2006 |
| JP | 2009-118152 | A | 5/2009 |
| JP | 2013-141211 | A | 7/2013 |

OTHER PUBLICATIONS

Official Communication issued in International Patent Application No. PCT/JP2016/079033, dated Dec. 20, 2016.

*Primary Examiner* — Graham P Smith
(74) *Attorney, Agent, or Firm* — Keating & Bennett, LLP

(57) ABSTRACT

An antenna element includes an antenna board, a radiation conductor including radiation portions including a top surface portion and being divided at positions corresponding to frequency bands and provided with respect to a first feeding point in plan view of the antenna board, through-conductors penetrating the antenna board at respective positions of end portions of the top surface portion in a thickness direction, and bottom surface electrodes provided on a bottom surface of the antenna board opposite the end portions of the top surface portion, and connected to the top surface portion via the through-conductors.

20 Claims, 15 Drawing Sheets

ANTENNA ELEMENT, ANTENNA UNIT AND COMMUNICATION MODULE

CROSS REFERENCE TO RELATED APPLICATIONS

This application claims the benefit of priority to Japanese Patent Application No. 2015-252525 filed on Dec. 24, 2015 and is a Continuation Application of PCT Application No. PCT/JP2016/079033 filed on Sep. 30, 2016. The entire contents of each application are hereby incorporated herein by reference.

BACKGROUND OF THE INVENTION

1. Field of the Invention

The present invention relates to an antenna element mounted on a motherboard, and an antenna unit including the motherboard and the antenna element, and a communication module including the antenna unit.

2. Description of the Related Art

In wireless systems for IoT (Internet of Things), such as a sensor network system and a lighting control system, multiband-support for a transceiver IC (Integrated Circuit) has been developed. Accordingly, a single IC may be used in a wireless system capable of supporting multiple frequency bands. However, since only a single band is used in a single wireless system in many cases, an antenna element is used only for a single band even in a wireless system, such as a communication module using a multiband-support IC.

Although sub-GHz bands and UHF bands are often used for IoT, countries and regions have allocated frequencies for the bands different from each other. Thus, an antenna element having a different configuration needs to be used for each place of destination, system, or the like, of a wireless system. Accordingly, at a manufacturer of the antenna element and a manufacturer manufacturing various devices containing the antenna element, the following problems may arise, for example. That is, management of production, inventory control, and logistics of the antenna element, for example, are complicated, or reduction in an amount of production for each kind of antenna element, and an increase in cost accompanying these problems, and so on may arise.

Accordingly, versatile antenna elements capable of supporting multiple bands have been proposed (for example, see Japanese Unexamined Patent Application Publication No. 2001-332924). According to these antenna elements, it is possible to support the multiple bands by selectively connecting conductors defining a radiation conductor by mounted components and adjusting an operating frequency.

In the related art, it is necessary to select positions and component values of the respective mounted components for adjusting the operating frequency, and therefore management of multiple kinds of antenna elements is complicated. The components are mounted by the manufacturer of various devices, and mounting the components on the antenna element may require an additional process in some cases. Further, mounting the components increases a height of an antenna portion, thus hindering a reduction in size. In addition, it is difficult to optimize antenna characteristics, because radiation elements (radiation conductors) not functioning effectively in a frequency desired to be used are included, and thus, unnecessary radiation is caused, for example.

SUMMARY OF THE INVENTION

Preferred embodiments of the present invention provide versatile antenna elements each capable of supporting multiple frequency bands while reducing the size of the antenna element and reducing unnecessary radiation.

An antenna element according to a preferred embodiment of the present invention is mounted on a motherboard, and includes a board; a radiation conductor including a plurality of radiation portions including a top surface portion provided on a top surface of the board, the plurality of radiation portions being divided at positions corresponding to multiple frequency bands and provided with respect to a first feeding point in plan view of the board; a through-conductor penetrating the board at a position of an end portion of the top surface portion in a thickness direction; and a bottom surface electrode provided on a bottom surface of the board opposite the end portion of the top surface portion, and connected to the top surface portion via the through-conductor.

As described above, by providing the through-conductor and the bottom surface electrode at the position of the end portion of the top surface portion of the radiation conductor including the plurality of radiation portions, it is possible to selectively connect the divided radiation portions of the radiation conductor to each other by the motherboard. Accordingly, it is possible to adjust an electrical length of a radiation conductor that is fed with a signal from the first feeding point, thus adjusting a resonant frequency of the radiation conductor. That is, the antenna element is capable of operating while supporting the multiple frequency bands.

Since the plurality of radiation portions are divided and arranged, even when only some of the radiation portions are connected to each other, the other radiation portions are unlikely to define a stub or a loop. Thus, even in the above-described case, unnecessary radiation is able to be reduced.

Further, it is possible to mount the board on a surface of the motherboard without providing a board-to-board connector, or other similar structure, thus reducing the size of the antenna element. In other words, with the antenna element according to a preferred embodiment of the present invention, it is possible to support the multiple frequency bands while reducing the size.

Further, by further providing a connection wire (a pattern conductor) on the motherboard, that is much shorter than the radiation conductor on the board, it is possible to connect the divided radiation portions of the radiation conductor to each other. Accordingly, radiation characteristics of the antenna element are unlikely to be affected by the connection wire of the motherboard. That is, by controlling tolerances of the plurality of radiation portions defining the radiation conductor of the antenna element, desired radiation characteristics are easily obtained.

Thus, it is possible to obtain a versatile antenna element capable of supporting multiple frequency bands while reducing the size and reducing unnecessary radiation.

Further, in the plan view of the radiation conductor, an end portion of a radiation portion, on a side of the first feeding point, of two adjacent divided radiation portions, may preferably be positioned so as not to face an end portion of the other of the two radiation portions.

As described above, the end portion of the one radiation portion on the first feeding point side of the two adjacent radiation portions does not face the end portion of the other radiation portion, thus making it possible to reduce coupling between the two radiation portions. Specifically, when there is a conductor in a signal propagation direction of the radiation conductor, an end portion of each of the plurality of radiation portions, as an open end viewed from the first feeding point, tends to be strongly coupled to the conductor. Such coupling may be a cause of unnecessary radiation from the conductor. Accordingly, with the configuration of the end portion of the radiation portion on the first feeding point side not facing the end portion of the other radiation portion, it is possible to reduce the unnecessary radiation.

Further, in the radiation conductor, each of two adjacent divided radiation portions may preferably be the top surface portion, and the through-conductor and the bottom surface electrode may preferably be provided corresponding to each of mutually divided end portions of the two radiation portions.

Accordingly, the two radiation portions are to be electrically connected to each other, by providing on the motherboard a connection wire that connects the bottom surface electrodes corresponding to the two radiation portions to each other. That is, the two radiation portions may be connected to each other, not by a jumper resistor, a switch, or other component, but by the motherboard itself on the surface of which the board is mounted.

Further, one of two adjacent divided radiation portions in the radiation conductor may preferably be the top surface portion, and the other of the two adjacent divided radiation portions may preferably be provided on a bottom surface of the board.

As described above, one of the two adjacent radiation portions is provided on the top surface of the board and the other is provided on the bottom surface, thus making it possible to reduce coupling between the two radiation portions. That is, when the one of the two radiation portions is used and the other is not used, it is possible to reduce unnecessary coupling so as to reduce unnecessary radiation.

Further, the radiation conductor may preferably include a bottom surface portion provided on the bottom surface of the board, and the bottom surface portion may be provided at a position farther from the first feeding point than the top surface portion.

As described above, since the bottom surface portion is provided at the position farther from the first feeding point than the top surface portion, the bottom surface portion becomes a radiation portion that is not used when a signal in a higher frequency band is radiated, and is used when a signal in a lower frequency band is radiated. Since the bottom surface portion is sandwiched between the board and the motherboard, an effective dielectric constant thereof is higher as compared to that of the top surface portion. That is, in the antenna element, the effective dielectric constant is high in a radiation portion which tends to increase in size in a propagation direction in order to radiate a signal in the lower frequency band. Thus, by reducing or preventing an increase in size of the radiation portion, the antenna element is further reduced in size.

Further, a first ground electrode adjacent to the radiation conductor in a lateral direction may preferably be included on the board, and the radiation conductor may be divided and provided on a side opposite the first ground electrode in the plan view.

As described above, the radiation conductor is divided on the side opposite the first ground electrode, thus coupling between the radiation conductor and the first ground electrode is reduced. Accordingly, fluctuation in characteristics of the antenna element due to the coupling between the radiation conductor and the first ground electrode is reduced.

An antenna unit according to a preferred embodiment of the present invention includes one of the above-described antenna elements; a motherboard on a top surface of which the antenna element is mounted using a conductive bonding material; and two top surface electrodes provided at positions on the top surface of the motherboard to face respective end portions of two adjacent divided radiation portions of the radiation conductor, and connected to the respective end portions using the conductive bonding material.

As described above, the antenna element and the motherboard are bonded to each other using the conductive bonding material, thus reducing the size, and particularly the profile, of the antenna unit. In addition, by including the antenna element, the antenna unit may be used for a desired frequency band among the multiple frequency bands. That is, the antenna unit may be used for the desired frequency band while reducing the size thereof and reducing unnecessary radiation.

Further, the two radiation portions may preferably not be fed with a signal from the first feeding point.

As described above, the two radiation portions not being fed with a signal are connected to each other, thus making it possible to separate resonant frequencies of the two radiation portions from an operating frequency of the radiation conductor. Thus, deterioration of the characteristics of the antenna element is reduced or prevented.

Further, one of the two radiation portions may preferably be fed with a signal from the first feeding point without the other of the two radiation portions being interposed therebetween, and the other of the two radiation portions may preferably be fed with a signal from the first feeding point with the one of the two radiation portions being interposed therebetween.

As described above, the other radiation portion is fed with a signal with the one radiation portion of the two radiation portions interposed therebetween, thus making it possible to radiate a signal in a low frequency band as compared to a case in which the other radiation portion is not fed with a signal with the one radiation portion of the two radiation portions interposed therebetween.

Further, the radiation conductor may preferably include two adjacent divided radiation portions, one of which is fed with a signal from the first feeding point and the other of which is not fed with a signal from the first feeding point, and the antenna unit may preferably further include a second ground electrode provided on the top surface of the motherboard to face an end portion of the other of the two radiation portions, and connected to the end portion with the conductive bonding material interposed therebetween.

As described above, since the other of the two radiation portions is connected to the second ground electrode, the other of the radiation portion becomes an unpowered element. That is, the other of the two radiation portions also has an antenna function, thus enabling the antenna unit to have a wider band.

Further, the antenna unit may preferably further include a third ground electrode provided on the top surface of the motherboard to cover at least one radiation portion that is not fed with a signal from the first feeding point of the radiation conductor.

As described above, the third ground electrode is provided so as to cover the radiation portion that is not fed with a signal, thus making it possible to reduce unnecessary coupling between a non-radiating radiation portion and a radiating radiation portion among the plurality of radiation portions defining the radiation conductor. Thus, unnecessary radiation is further reduced.

Further, the antenna unit may preferably further include a frequency adjustment impedance element provided on the motherboard and located on a connection path between the first feeding point and the radiation conductor.

As described above, the impedance element is provided on the motherboard, thus making it possible to appropriately adjust a constant of the impedance element in accordance with an operating frequency among the multiple frequency bands. Thus, characteristics of the antenna unit are improved or optimized.

The antenna unit may preferably further include a wire provided on the motherboard and connecting the radiation conductor and a second feeding point different from the first feeding point, and in the radiation conductor, a first group including at least one radiation portion of the plurality of radiation portions may preferably be connected to the first feeding point and not be connected to the second feeding point, and a second group including at least one other radiation portion of the plurality of radiation portions may preferably not be connected to the first feeding point and be connected to the second feeding point.

As described above, since the first group is connected to the first feeding point and the second group is connected to the second feeding point, switching between various operations are able to be performed in the antenna unit.

The antenna unit may preferably perform an antenna diversity operation using the first group and the second group by selectively feeding a signal in at least one frequency band among the multiple frequency bands to one of the first feeding point and the second feeding point.

As described above, by performing the antenna diversity operation using the first group and the second group, deterioration of characteristics in a higher frequency band in which the deterioration of characteristics due to phasing or directivity particularly tends to increase are reduced.

Further, in the antenna unit, the first group and the second group may preferably transmit or receive respective signals having frequency bands different from each other, by feeding a signal in one frequency band among the multiple frequency bands to the first feeding point, and feeding a signal in another frequency band to the second feeding point.

As described above, since the first group and the second group transmit or receive the respective signals in frequency bands different from each other, it is possible to support communication systems, such as a wireless module, using multiple frequency bands.

A communication module according to a preferred embodiment of the present invention includes one of the above-described antenna units and a communication circuit that performs communication using the antenna unit.

According to the communication module, since the above-described antenna unit is included, it is possible support multiple frequency bands while reducing the size thereof and reducing unnecessary radiation.

According to preferred embodiments of the present invention, it is possible to provide antenna units that support multiple frequency bands while reducing the size thereof and reducing unnecessary radiation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
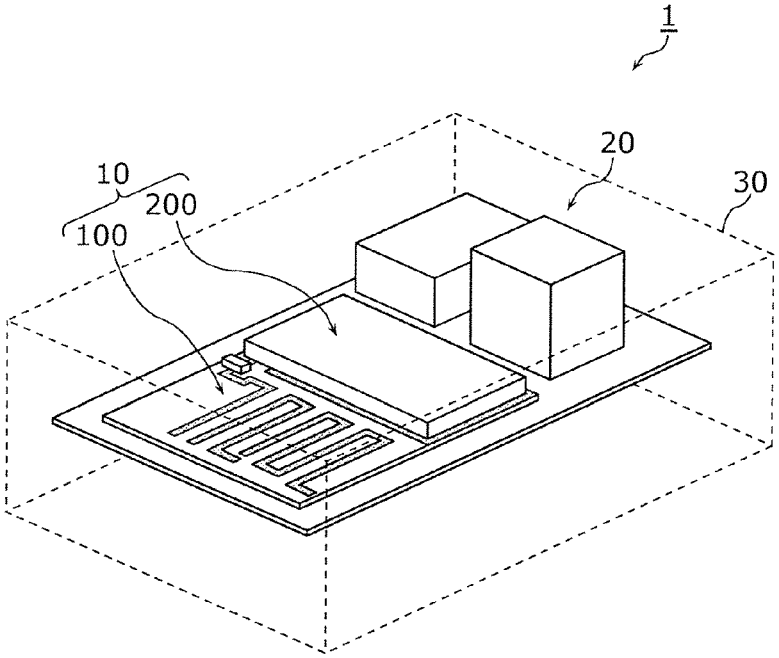
FIG. 1 is a perspective view illustrating a configuration of a wireless sensor including a communication module according to Preferred Embodiment 1 of the present invention.

Hereinafter, antenna elements, antenna units, and communication modules according to preferred embodiments of the present invention will be described using wireless sensors including the antenna elements, the antenna units, and the communication modules as examples with reference to the drawings. Note that, each of the preferred embodiments described below illustrates a preferred example of the present invention. The numerical values, shapes, materials, elements, arrangement positions of elements, forms of connection, and other features described in the following preferred embodiments are merely examples, and are not intended to limit the present invention. Additionally, of the elements described in the following preferred embodiments, elements not mentioned in the independent claims are described as optional elements.

Note that, each figure is a schematic view and is not always strictly illustrated. Additionally, in each of the figures, identical reference numerals are used for substantially identical configurations, and a duplicate explanation is omitted or simplified in some cases. Further, hereinafter, not only cross-sectional views but also perspective views and top views are hatched for simplification in some cases.

Preferred Embodiment 1

First, a configuration of a communication module will be described.

Figure 2:
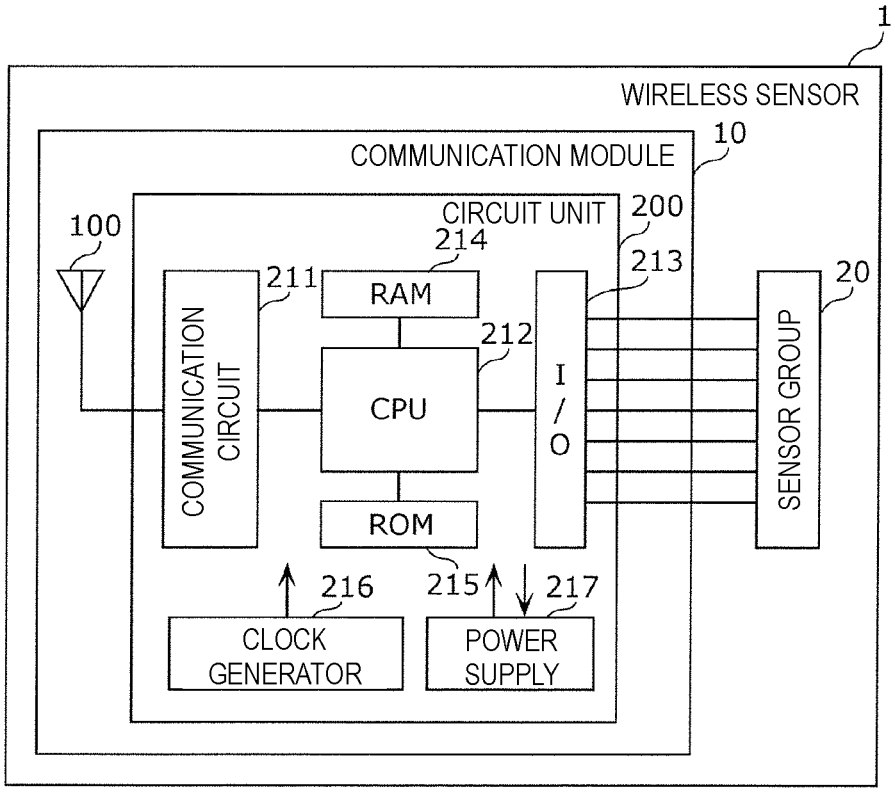
FIG. 2 is a block diagram illustrating a functional configuration of the wireless sensor including the communication module according to Preferred Embodiment 1 of the present invention.

FIG. 1 is a perspective view illustrating a configuration of a wireless sensor 1 including a communication module 10 according to the present preferred embodiment. Additionally, FIG. 2 is a block diagram illustrating a functional configuration of the wireless sensor 1 including the communication module 10 according to the present preferred embodiment. Note that, in FIG. 1, elements arranged inside a housing 30 are illustrated, by seeing through the housing 30 of the wireless sensor 1. Additionally, hereinafter, although explanations will be provided with an upper side of a paper surface of FIG. 1 being an upside, the upper side of a paper surface may not be the upside depending on the particular use of the wireless sensor 1. Thus, the upper side of a paper surface of FIG. 1 is not limited to an upside of the wireless sensor 1.

The wireless sensor 1, for example, measures temperature, humidity, illuminance, or other parameters, and periodically transmits data indicating the measured values to an external data aggregation device (not illustrated). The wireless sensor 1 transmits the data with a given band used in a wireless system to which the wireless sensor 1 is applied.

As illustrated in FIG. 1 and FIG. 2, the wireless sensor 1 includes the communication module 10, a sensor group 20 including one or more sensor elements, and the housing 30 including the communication module 10 and the sensor group 20.

The communication module 10 includes an antenna unit 100 and a circuit unit 200 for communication using the antenna unit 100, and, for example, is preferably a module that transmits data indicating values measured by the sensor group 20 with a given band.

The antenna unit 100 is capable of supporting multiband, and in the present preferred embodiment, is configured corresponding to a given band, among multiple bands, used in a wireless system to which the wireless sensor 1 is applied. The antenna unit 100 will be described below in detail.

The circuit unit 200 is preferably a multiband-support transceiver IC, for example, and in the present preferred embodiment, is a communication circuit that communicates using the given band, among the multiple bands, used in the wireless system to which the wireless sensor 1 is applied. The circuit unit 200, as illustrated in FIG. 2, for example, as a functional block, includes a communication circuit 211, a CPU 212, an I/O 213 defining a connection interface to the sensor group 20, a RAM 214, a ROM 215, a clock generator 216, and a power supply 217. For example, in the circuit unit 200, the CPU executes a program stored in the ROM 215 to instruct the sensor group 20 to measure, and data indicating the measured values are transmitted from the communication circuit 211 via the antenna unit 100. Note that, the configuration of the circuit unit 200 is not limited thereto, and, for example, a portion of multiple functional blocks included in the circuit unit 200 and at least a portion of another portion may be defined by different hardware circuits.

The sensor group 20 includes one or more sensor elements, such as a temperature sensor, a humidity sensor, or an illuminance sensor, for example, and perform measurement in accordance with an instruction from the circuit unit 200, for example. Note that, the sensor elements included in the sensor group 20 are not limited thereto, and, for example, a gyro sensor or a magnetic sensor may be included. Further, the number of sensor elements included in the sensor group 20 is not limited, that is, the number may be one or more.

The housing 30, for example, is a case defining an external housing of the wireless sensor 1, and protects the communication module 10, the sensor group 20, and other components against impacts and other external forces.

Next, a configuration of the antenna unit 100 will be described.

Figure 3:
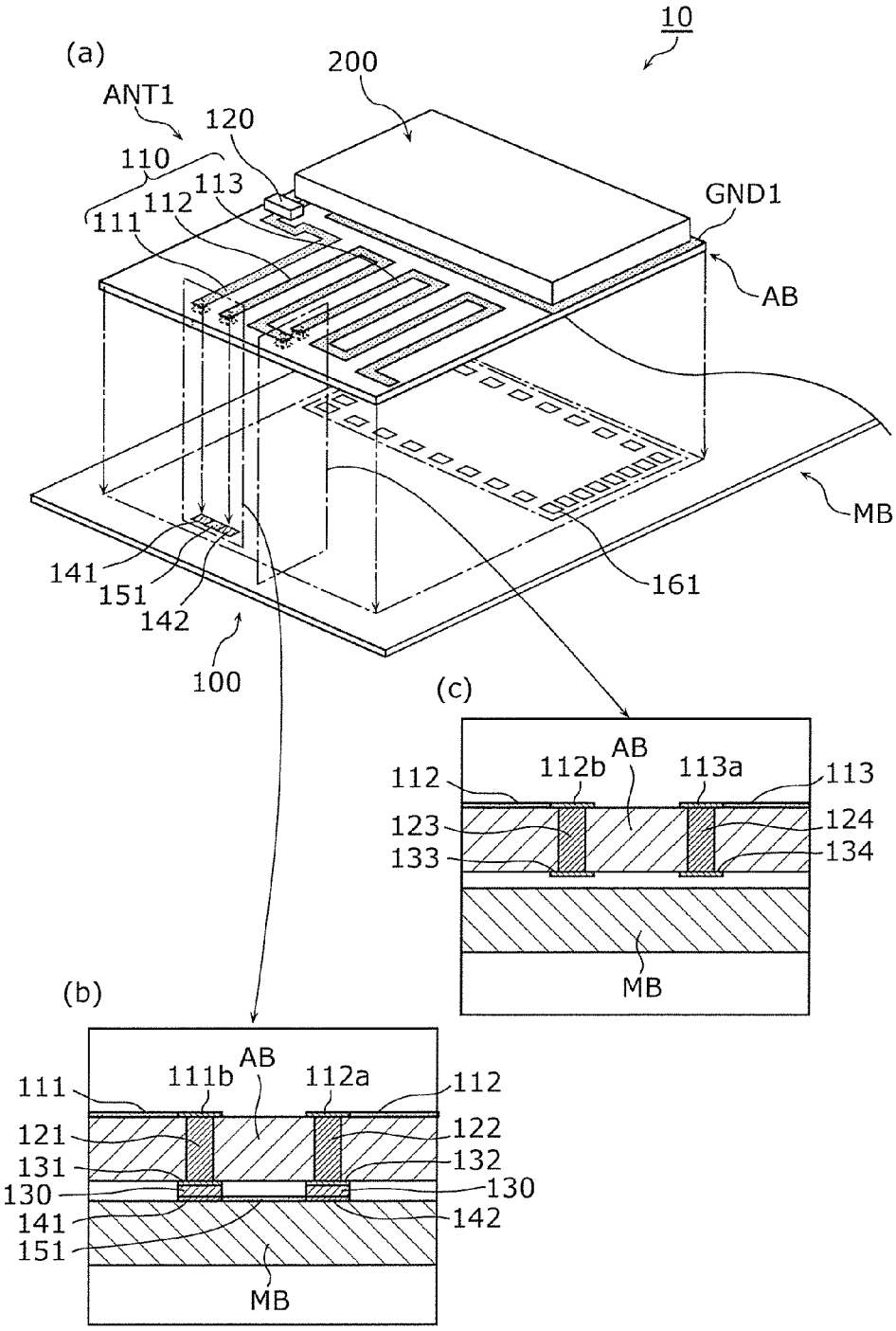
FIG. 3 includes diagrams illustrating an exemplary configuration of an antenna unit according to Preferred Embodiment 1 of the present invention.
Figure 4:
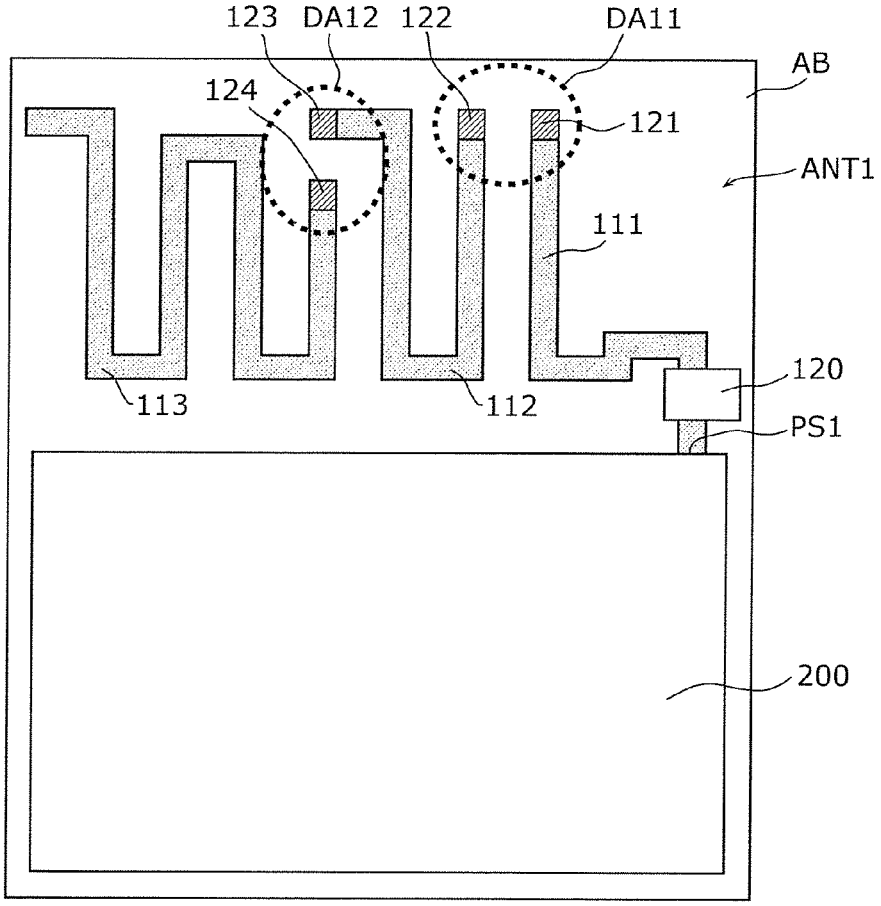
FIG. 4 is a top view of an antenna element according to Preferred Embodiment 1 of the present invention.

FIG. 3 includes diagrams illustrating an exemplary configuration of the antenna unit 100 according to Preferred Embodiment 1. Specifically, (a) of FIG. 3 is a perspective view of the antenna unit 100, and (b) and (c) of FIG. 3 are cross-sectional views of main portions of (a) of FIG. 3. FIG. 4 is a top view of an antenna element ANT1 according to Preferred Embodiment 1. Note that, the circuit unit 200, defining the communication module 10 together with the antenna unit 100, is also illustrated in FIG. 3 and FIG. 4. This similarly applies to the following perspective views and top views of the antenna unit 100. Additionally, (a) and (c) of FIG. 3 are diagrams conceptually illustrating respective positional relationships among individual elements. Thus, an element not being in the same cross-section in a strict sense is also illustrated. This similarly applies to the following cross-sectional views.

The antenna unit 100 illustrated in (a) and (c) of FIG. 3 and FIG. 4, for example, includes the antenna element ANT1 preferably capable of supporting three bands, that is, a 2450 MHz band, a 920 MHz band, and a 400 MHz band, for example, and in (a) to (c) of FIG. 3, a configuration corresponding to the 920 MHz band among the three bands is illustrated. This antenna unit 100 includes the antenna element ANT1, an impedance element 120, and a motherboard MB on the top surface of which the antenna element ANT1 is mounted using a conductive bonding material 130.

The antenna element ANT1 is mounted on the motherboard MB, and includes an antenna board AB, a radiation conductor 110, one or more through-conductors (for example, preferably four through-conductors 121 to 124 in the present preferred embodiment), and one or more bottom surface electrodes (for example, preferably four bottom surface electrodes 131 to 134 in the present preferred embodiment). Additionally, in the present preferred embodiment, the antenna element ANT1 includes a ground electrode GND1 connected to the circuit unit 200.

The antenna board AB is a board the bottom surface of which faces and is bonded onto a top surface of the motherboard MB using the conductive bonding material 130. That is, the antenna element ANT1 is mounted on the antenna board AB on a surface of the motherboard MB.

The radiation conductor 110 includes multiple radiation portions 111 to 113 including a top surface portion provided on a top surface of the antenna board AB. The multiple radiation portions 111 to 113 are, for example, pattern conductors divided at positions corresponding to multiple frequency bands and provided with respect to a first feeding point PS1, in plan view of the antenna board AB. Specifically, the radiation conductor 110 is divided in two division area DA11 and DA12 in the plan view, and thus, includes the three radiation portions 111 to 113. In the present preferred embodiment, for example, the radiation portion 111, the radiation portion 112, and the radiation portion 113 are preferably provided in this order from a first feeding point PS1 side.

The radiation conductor 110, for example, preferably defines a monopole antenna, and an entire length when assumed not to be divided corresponds to an electrical length of a substantially ¼ wave length in a lowest band among the multiple bands. That is, a radiation portion defined by connecting the radiation portions 111 to 113 to each other preferably has an electrical length of a substantially ¼ wave length in the 400 MHz band, for example. Further, a radiation portion defined by connecting the radiation portion 111 and the radiation portion 112 preferably has an electrical length of a substantially ¼ wave length in the 920 MHz band, for example. Further, the radiation portion 111 preferably has an electrical length of a substantially ¼ wave length in the 2450 MHz band, for example.

Additionally, in the present preferred embodiment, the radiation conductor 110 preferably has a meandering shape divided by electrical lengths corresponding to the multiple bands with respect to the first feeding point PS1. Specifically, folded portions of the radiation conductor 110 defined by the meandering shape are positioned on a side of the ground electrode GND1 and on a side opposite thereof. Additionally, in the present preferred embodiment, the radiation conductor 110 is divided and provided on the side opposite the ground electrode GND1 in plan view of the antenna board AB. That is, the radiation conductor 110 is divided not at a folded portion on a side near the ground electrode GND1, but at a folded portion positioned on the side opposite the ground electrode GND1 (a far side from the ground electrode GND1).

Additionally, in the present preferred embodiment, in plan view of the antenna board AB, the radiation conductor 110 is provided such that an end portion of a radiation portion on the first feeding point PS1 side, of the two adjacent divided radiation portions, does not face an end portion of the other radiation portion. Specifically, when focusing on the radiation portion 111 and the radiation portion 112, as illustrated in (b) of FIG. 3, an end portion 111*b* of the radiation portion 111 on a side of the radiation portion 112 does not face an end portion 112*a* of the radiation portion 112 on a side of the radiation portion 111. Additionally, when focusing on the radiation portion 112 and the radiation portion 113, as illustrated in (c) of FIG. 3, an end portion 112*b* of the radiation portion 112 on a side of the radiation portion 113 does not face an end portion 113*a* of the radiation portion 113 on a side of the radiation portion 112. That is, an extension direction of an end portion (end portion on a far side from the first feeding point PS1) of the radiation portion on the first feeding point PS1 side, of the two adjacent divided radiation portions, is different from a direction in which an end portion of the other radiation portion is provided.

The through-conductors 121 to 124 are via conductors that penetrate the antenna board AB in a thickness direction at positions of end portions of a top surface portion (the radiation portions 111 to 113 in the present preferred embodiment) among the multiple radiation portions 111 to 113 defining the radiation conductor 110. Specifically, the through-conductor 121 is provided at a position of the end portion 111*b* of the radiation portion 111 on the side of the radiation portion 112, and the through-conductor 122 is provided at a position of the end portion 112*a* of the radiation portion 112 on the side of the radiation portion 111. Additionally, the through-conductor 123 is provided at a position of the end portion 112*b* of the radiation portion 112 on the side of the radiation portion 113, and the through-conductor 124 is provided at a position of the end portion 113*a* of the radiation portion 113 on the side of the radiation portion 112.

The bottom surface electrodes 131 to 134 are pad electrodes provided on a bottom surface of the antenna board AB so as to face end portions of the top surface portion (the radiation portions 111 to 113 in the present preferred embodiment). Further, the bottom surface electrodes 131 to 134 are electrodes connected to the top surface portion via the through-conductors 121 to 124, and are electrodes to mount the antenna element ANT1 on the surface of the motherboard MB. Specifically, the bottom surface electrode 131 faces the end portion 111*b* and connected to the radiation portion 111 via the through-conductor 121. Note that, since the other bottom surface electrodes 132 to 134 are similar to the bottom surface electrode 131 except for respective arrangement positions and connection targets, detailed descriptions thereof are omitted.

As described above, in the present preferred embodiment, each of the two adjacent divided radiation portions (here, the radiation portion 111 and the radiation portion 112, and the radiation portion 112 and the radiation portion 113) of the radiation conductor 110 defines the top surface portion. Further, the through-conductors 121 and 122 and the bottom surface electrodes 131 and 132 correspond to the divided end portions of the two radiation portions (here, end portion 111*b* and the end portion 112*a*), respectively, and through-conductors 123 and 124 and the bottom surface electrodes 133 and 134 correspond to the mutually divided end portions of the two radiation portions (here, end portion 112*b* and the end portion 113*a*), respectively.

The ground electrode GND1 is provided adjacent to the radiation conductor 110 in a lateral direction on the antenna board AB. In the present preferred embodiment, the ground electrode GND1 and the radiation conductor 110 are provided side by side on the top surface of the antenna board AB. For example, in plan view of the antenna board AB, the ground electrode GND1 is provided across an entire or substantially an entire width of the radiation conductor 110 in a direction orthogonal or substantially orthogonal to an alignment direction of the ground electrode GND1 and the radiation conductor 110.

The antenna element ANT1 described above, has a versatile configuration capable of transmitting and receiving signals in multiple bands. That is, the antenna element ANT1 may be used in common for the multiple bands. Specifically, the antenna element ANT1 transmits or receives a signal in any of the multiple bands by being mounted on the motherboard MB and the multiple radiation portions 111 to 113 being connected.

Note that, although a material of the antenna board AB is not specifically limited as long as the material is dielectric, for example, a grass epoxy board, or other board made of a suitable material may preferably be used. Additionally, although respective materials of the radiation conductor 110, the through-conductors 121 to 124, the bottom surface electrodes 131 to 134, and the ground electrode GND1 are not specifically limited as long as the materials are conductive materials, for example, gold, silver, copper, alloy thereof, or other suitable conductive material may preferably be used.

The impedance element 120 provides frequency adjustment and is disposed on a connection path between the first feeding point PS1 and the radiation conductor 110, and in the present preferred embodiment, is provided on the top surface of the antenna board AB. The impedance element 120, for example, preferably includes an inductor and a capacitor connected in shunt between the connection path and ground, and is a circuit that improves impedance matching between the first feeding point PS1 and the radiation conductor 110. That is, the impedance element 120 adjusts input impedance of the antenna element ANT1 mounted on the motherboard MB.

The antenna element ANT1 is mounted on the top surface of the using the conductive bonding material 130, such as solder, and defines the antenna unit 100 together with the antenna element ANT1. Accordingly, the antenna unit 100 including the antenna element ANT1 that is operable (transmittable or receivable) in the multiple bands operates with one of the multiple bands.

On the motherboard MB, depending on the mode of use of the antenna element ANT1, top surface electrodes (two top surface electrodes 141 and 142 in FIG. 3), and a connection wire (one connection wire 151 in FIG. 3) may preferably be provided, for example. Further, in the present preferred embodiment, a land 161 to be electrically connected to the circuit unit 200 is provided on the motherboard MB. Note that, the top surface electrode and the connection wire will be described below. Additionally, although a material of the motherboard MB is not specifically limited as long as the material is dielectric, for example, a material similar to the antenna board AB may preferably be used. Further, although materials of the top surface electrode, connection wire, and land 161 are not specifically limited as long as the materials are conductive materials, for example, materials similar to the radiation conductor 110, the through-conductors 121 to 124, the bottom surface electrodes 131 to 134, and the ground electrode GND1 may preferably be used.

Hereinafter, configurations of the antenna unit 100 including the antenna element ANT1 will be described together with a configuration of the motherboard MB.

Figure 5:
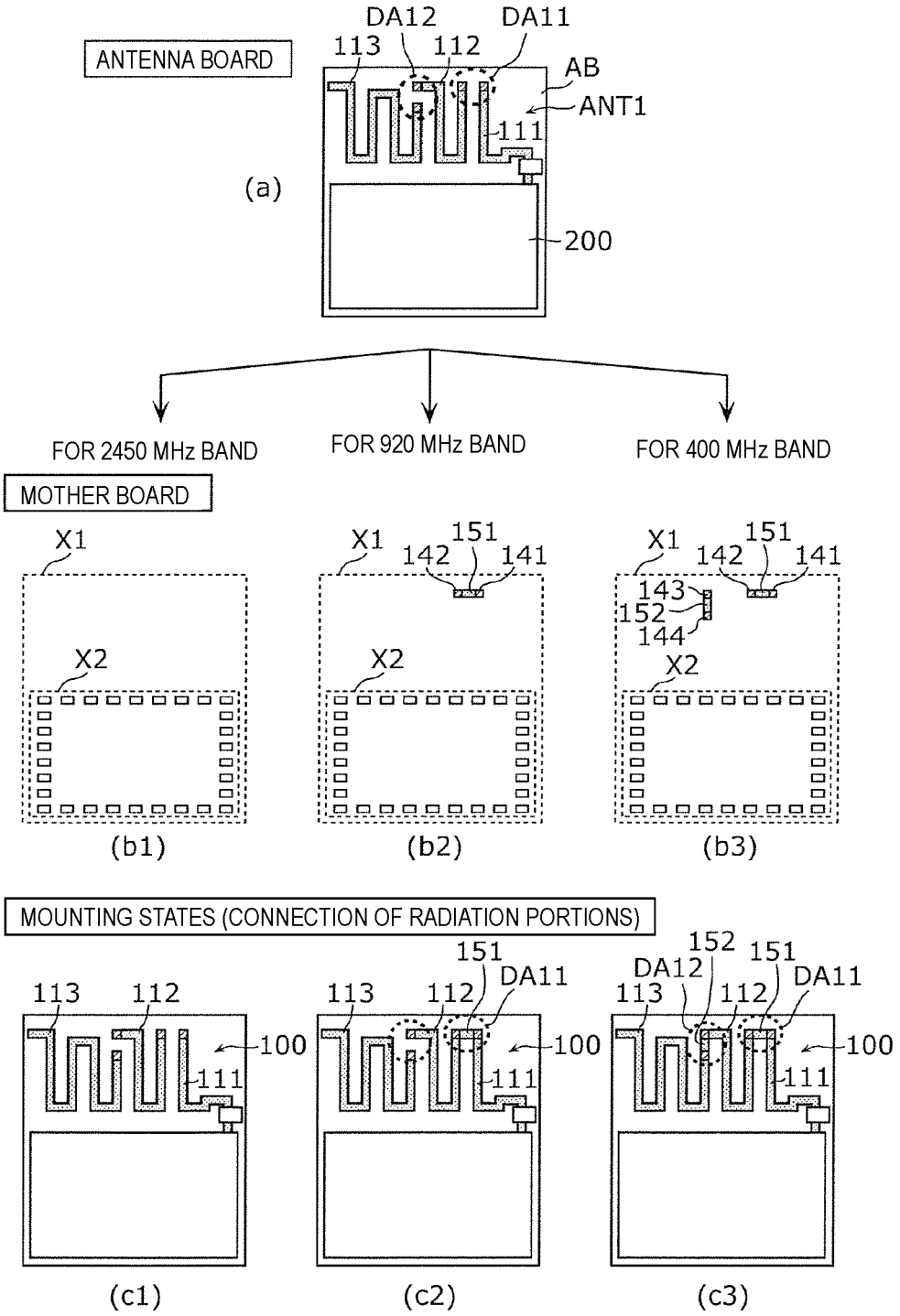
FIG. 5 is a diagram illustrating modes of use of the antenna element according to Preferred Embodiment 1 of the present invention.

FIG. 5 is a diagram illustrating the modes of use of the antenna element ANT1 according to the present preferred embodiment, and illustrates modes of use about respective multiple bands. Specifically, FIG. 5 is a diagram schematically illustrating configurations of the antenna units 100 for the 2450 MHz band, the 920 MHz band, and the 400 MHz band using the antenna element ANT1 in common illustrated in (a).

More specifically, (a) of FIG. 5 is a top view of the antenna board AB, each of (b1) to (b3) of FIG. 5 is a top view of the motherboard MB, and each of (c1) to (c3) of FIG. 5 is a top view when the antenna board AB is mounted on the corresponding motherboard MB. Additionally, (b1) and (c1) of FIG. 5 are top views for the 2450 MHz band, (b2) and (c2) of FIG. 5 are top views for the 920 MHz band, and (b3) and (c3) of FIG. 5 are top views for the 400 MHz band. Further, areas X1 and X2 in (b1) to (b3) of FIG. 5 denote an arrangement area of the antenna board AB and an arrangement area of the circuit unit 200 on the motherboard MB, respectively. Note that, in (c1) to (c3) of FIG. 5, to simplify the connection of the radiation portions 111 to 113, a portion of the antenna board AB is seen through and illustrated. The above-described matters are similarly applied to the following figures illustrating modes of use.

As illustrated in (b1) of FIG. 5, when the antenna element ANT1 is used for the 2450 MHz band, no wires connecting the radiation portions 111 to 113 are provided on the motherboard MB. Accordingly, as illustrated in (c1) of FIG. 5, the radiation portions 111 to 113 remain in a state of being divided even when the antenna board AB is mounted on the motherboard MB. Thus, the antenna unit 100 operates in the 2450 MHz band corresponding to a length of the radiation portion 111.

Additionally, as illustrated in (b2) of FIG. 5, when the antenna element ANT1 is used for the 920 MHz band, the two top surface electrodes 141, 142 and the connection wire 151 are provided on the motherboard MB.

The top surface electrodes 141 and 142 are, as illustrated in FIG. 3, pad electrodes, for example, provided at positions of the top surface of the motherboard MB, and facing respective end portions (here, the end portion 111*b* of the radiation portion 111 and the end portion 112*a* of the radiation portion 112) of the two adjacent divided radiation portions of the radiation conductor 110. These top surface electrodes 141 and 142 are connected to the bottom surface electrodes 131 and 132 facing with the conductive bonding material 130 interposed therebetween.

The connection wire 151 is, for example, a pattern wire provided on the motherboard MB, one end thereof is connected to one of the two top surface electrodes 141 and 142, and the other end thereof is connected to the other of the two top surface electrodes 141 and 142. In the present preferred embodiment, the connection wire 151 is preferably arranged on the top surface of the motherboard MB, and connects the top surface electrode 141 and the top surface electrode 142 by a shortest distance in plan view of the motherboard MB.

Note that, the configuration of the connection wire 151 is not limited thereto, and the connection wire 151 may be arranged in an inner layer or on a bottom surface of the motherboard MB, for example. However, by shortening a wire length of the connection wire 151, it is possible to control antenna characteristics of the antenna unit 100 using the antenna element ANT1. That is, by shortening the wire length of the connection wire 151 and appropriately controlling a tolerance of a pattern conductor of the radiation conductor 110, stable antenna characteristics are obtained.

By providing the top surface electrodes 141, 142 and the connection wire 151, as illustrated in (c2) of FIG. 5, when the antenna board AB is mounted on the motherboard MB, the radiation portion 111 is connected to the radiation portion 112 with the connection wire 151 interposed therebetween. Thus, the antenna unit 100 operates in the 920 MHz band corresponding to the length of the radiation portion 111 and the radiation portion 112.

Additionally, as illustrated in (b3) of FIG. 5, when the antenna element ANT1 is used for the 400 MHz band, two top surface electrodes 143, 144 and a connection wire 152 are further provided on the motherboard MB, as compared to the 920 MHz band.

The top surface electrodes 143 and 144 are provided at positions of the top surface of the motherboard MB, and face the end portion 112*b* of the radiation portion 112 and the end portion 113*a* of the radiation portion 113, respectively. Additionally, the connection wire 152 connects the top surface electrodes 143 and 144 to each other. Note that, since the top surface electrodes 143, 144 and the connection wire 152 are similar to the top surface electrodes 141, 142 and the connection wire 151, respectively, except for arrangement positions and connection targets, detailed descriptions thereof are omitted.

By providing the top surface electrodes 143, 144 and the connection wire 152, in addition, the top surface electrodes 141, 142 and the connection wire 151, as illustrated in (c3) of FIG. 5, when the antenna board AB is mounted on the motherboard MB, the radiation portions 111 to 113 are connected to each other with the connection wires 151 and 152 interposed therebetween. Thus, the antenna unit 100 operates in the 400 MHz band corresponding to the length of the radiation portions 111 to 113.

The configurations of the antenna element ANT1, and other components, according to the present preferred embodiment have been described above. Hereinafter, advantageous effects obtained by the antenna element ANT1, and the antenna unit 100 and the communication module 10 including the antenna element ANT1 will be described.

As described above, with the antenna element ANT1 according to the present preferred embodiment, by providing the through-conductors 121 to 124 and the bottom surface electrodes 131 to 134 at the positions of the end portions of the top surface portion (the radiation portions 111 to 113 in the present preferred embodiment) of the radiation conductor 110 including the multiple radiation portions 111 to 113, it is possible to selectively connect the divided radiation portions 111 to 113 of the radiation conductor 110 to each other by the motherboard MB. This makes it possible to adjust an electrical length of the radiation conductor 110 being fed with a signal from the first feeding point PS1, thus adjusting a resonant frequency of the radiation conductor 110. That is, the antenna element ANT1 is capable of operating in the multiple frequency bands. Additionally, it is possible to mount the antenna board AB on the surface of the motherboard MB without providing a board-to-board connector, thus reducing the size of the antenna element ANT1. That is, with the antenna element ANT1 according to the present preferred embodiment, it is possible to support the multiple frequency bands while reducing the size thereof and reducing unnecessary radiation.

Additionally, by further providing the connection wires 151 and 152, that are much shorter than the radiation conductor 110 on the antenna board AB, on the motherboard MB, it is possible to connect the divided radiation portions 111 to 113 of the radiation conductor 110 to each other. Thus, radiation characteristics of the antenna element ANT1 are unlikely to be affected by the connection wires 151 and 152 on the motherboard MB. That is, by controlling tolerances of the multiple radiation portions 111 to 113 defining the radiation conductor 110 of the antenna element ANT1, desired radiation characteristics are easily obtained.

As an antenna element supporting the multiple frequency bands, for example, a configuration in which an operating frequency is changed by selectively connecting folded portions of a meandering shaped antenna pattern may be provided. However, with such configuration, when the operating frequency is shifted to a higher frequency band by connecting the folded portions, there is a risk that an unused antenna pattern defines a stub or a loop to cause unnecessary resonance, coupling, or other interference. Accordingly, in such antenna element, deterioration of antenna performance, such as deterioration of radiation efficiency and variation in directivity may be caused.

Compared to this, with the antenna element ANT1 according to the present preferred embodiment, the multiple radiation portions 111 to 113 defining the radiation conductor 110 are divided and arranged. Accordingly, even when only some of the multiple radiation portions 111 to 113 are connected to each other by the motherboard MB, the other radiation portions are unlikely to define a stub or a loop. Thus, with the antenna element ANT1, the unnecessary radiation is reduced or prevented. That is, the deterioration of antenna performance is reduced.

Specifically, with the antenna element ANT1 according to the present preferred embodiment, two adjacent radiation portions (the radiation portion 111 and the radiation portion 112, and the radiation portion 112 and the radiation portion 113 in the present preferred embodiment) are electrically connected to each other, by providing the connection wires 151 and 152 on the motherboard MB. The connection wire 151 connects the bottom surface electrodes 131 and 132 corresponding to the radiation portion 111 and 112, and the connection wire 152 connects the bottom surface electrodes 133 and 134 corresponding to the radiation portions 112 and 113. That is, the two radiation portions may be connected to each other, not by a jumper resistor, a switch, or other such component, but by the motherboard MB itself on the surface of which the antenna board AB is mounted.

Additionally, according to the antenna element ANT1 of the present preferred embodiment, the end portion of the radiation portion on the first feeding point PS1 side of the two adjacent radiation portions does not face the end portion of the other of the two adjacent radiation portions, thus making it possible to reduce coupling between the two radiation portions. Specifically, when there is a conductor in a signal propagation direction of the radiation conductor 110, an end portion of each of the multiple radiation portions 111 to 113 as an open end viewed from the first feeding point PS1 tends to be strongly coupled to the conductor. This coupling may cause the unnecessary radiation from the conductor. Accordingly, since the end portion of the radiation portion on the first feeding point PS1 side of the two adjacent radiation portions does not face the end portion of the other of the two adjacent radiation portions, it is possible to reduce the unnecessary radiation.

Additionally, with the antenna element ANT1 according to the present preferred embodiment, the radiation conductor 110 is divided on a side opposite the first ground electrode (the ground electrode GND1 in the present preferred embodiment), thus coupling between the radiation conductor 110 and the first ground electrode is reduced. That is, since an open end of each of the multiple radiation portions 111 to 113 is arranged at a position far from the first ground electrode, fluctuation in characteristics of the antenna element ANT1 due to the coupling between the radiation conductor 110 and the first ground electrode is reduced.

Additionally, with the antenna element ANT1 according to the present preferred embodiment, the radiation conductor 110 has a meandering shape, thus making it easy to adjust lengths of the multiple radiation portions 111 to 113. Accordingly, the antenna element ANT1 capable of using each of the multiple frequency bands as an operating frequency is easily obtained.

Further, with the antenna unit 100 according to the present preferred embodiment, the antenna element ANT1 and the motherboard MB are bonded to each other using the conductive bonding material 130, thus reducing the size thereof, and particularly the profile thereof. Additionally, by including the antenna element ANT1, the antenna unit may be used for a desired frequency band among the multiple frequency bands. That is, the antenna unit 100 may be used for the desired frequency band while reducing the size thereof.

Specifically, with the antenna unit 100 according to the present preferred embodiment, the two adjacent radiation portions defining the radiation conductor 110 are electrically connected to each other by the two top surface electrodes and the connection wire. This makes it possible to electrically connect two desired adjacent radiation portions defining the radiation conductor 110 to each other, thus adjusting the resonant frequency of the radiation conductor 110. In other words, with the antenna unit 100 according to the present preferred embodiment, it is possible to support the multiple frequency bands while reducing the size thereof.

Additionally, with the communication module 10 according to the present preferred embodiment, the antenna unit 100 is included, thus making is possible to support the multiple frequency bands while reducing the size of the communication module 10.

Modification 1 of Preferred Embodiment 1

In Preferred Embodiment 1, the radiation conductor 110 includes the radiation portions 111 to 113, and each of the radiation portions is the top surface portion. However, a radiation conductor may include bottom surface portions provided on a bottom surface of the antenna board AB. Accordingly, hereinafter, a communication module 10A according to Modification 1 of Preferred Embodiment 1 will be described using a communication module including the radiation conductor as an example. Note that, in the present modification, since a functional configuration of the communication module 10A is similar to Preferred Embodiment 1, description thereof is omitted.

Figure 6:
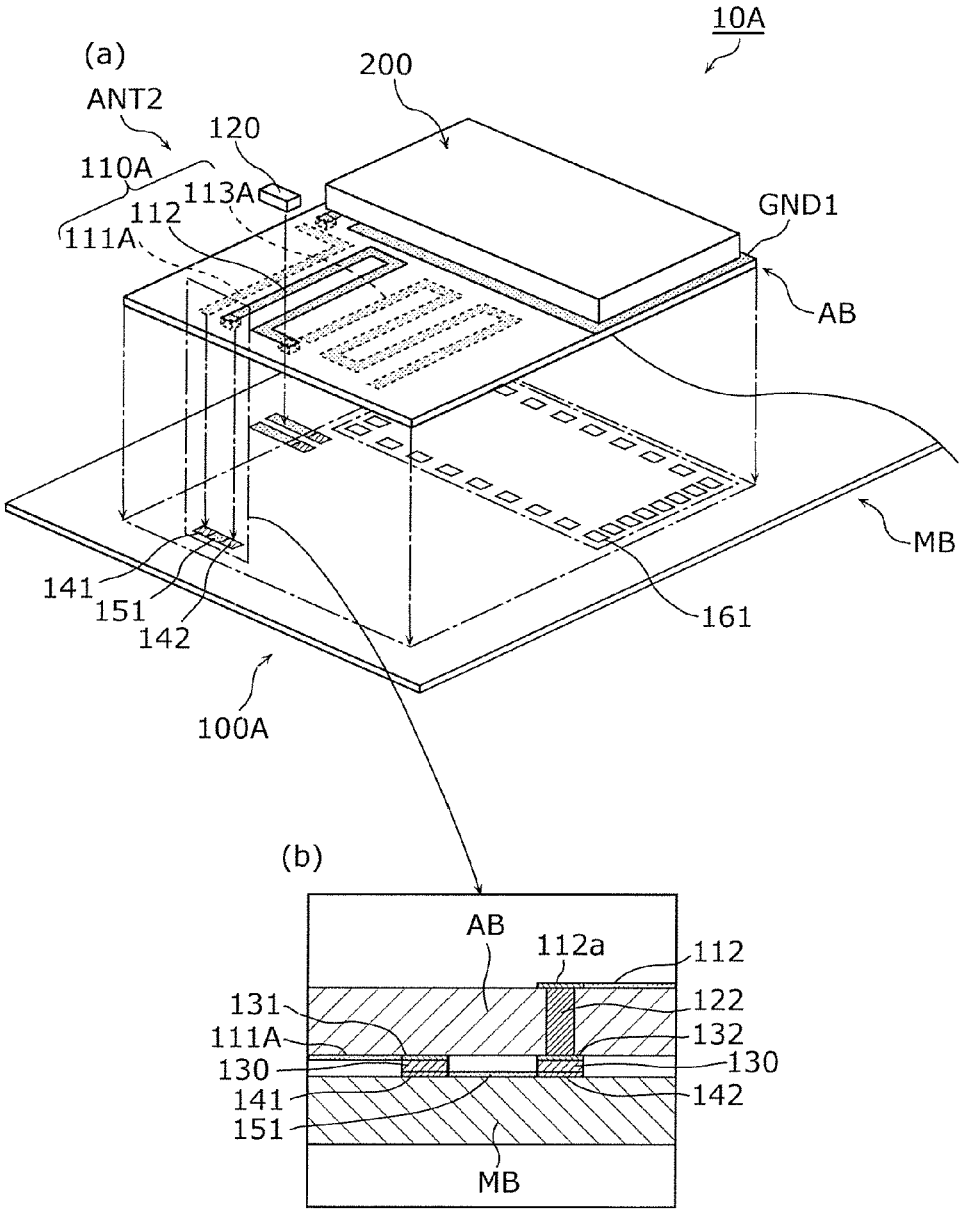
FIG. 6 is a diagram illustrating an exemplary configuration of an antenna unit according to Modification 1 of Preferred Embodiment 1 of the present invention.
Figure 7:
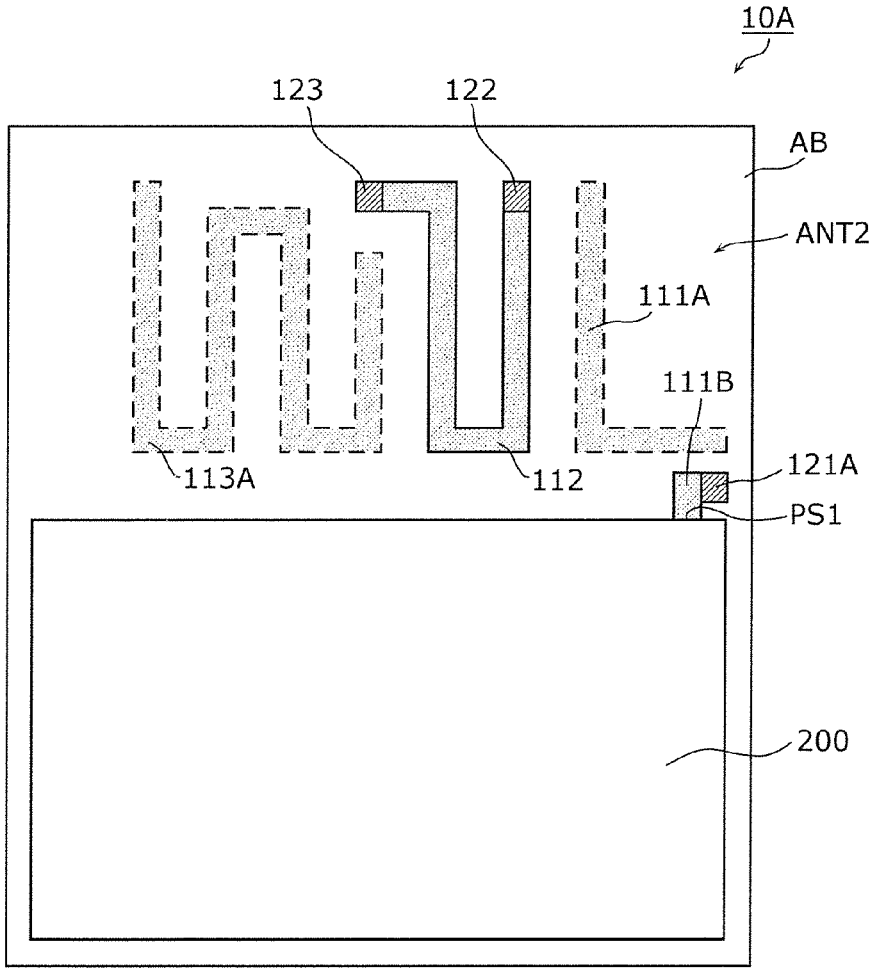
FIG. 7 is a top view of an antenna element according to Modification 1 of Preferred Embodiment 1 of the present invention.

FIG. 6 is a diagram illustrating an exemplary configuration of an antenna unit 100A according to Modification 1 of Preferred Embodiment 1. Specifically, (a) of FIG. 6 is a perspective view of the antenna unit 100A, and (b) of FIG. 6 is a cross-sectional view of main portions of (a) of FIG. 6. FIG. 7 is a top view of an antenna element ANT2 according to Modification 1 of Preferred Embodiment 1.

As illustrated in FIGS. 6 and 7, the antenna element ANT2 according to the present modification includes a radiation conductor 110A including radiation portions 111A and 113A, instead of the radiation conductor 110 including the radiation portions 111 and 113, compared to Preferred Embodiment 1. Additionally, in the present modification, the impedance element 120 is provided on the motherboard MB and is arranged on a connection path between the first feeding point PS1 and the radiation conductor 110A.

Each of the radiation portions 111A and 113A is a bottom surface portion provided on the bottom surface of the antenna board AB. That is, in the present modification, one of the two adjacent divided radiation portions (here, the radiation portion 111A and the radiation portion 112, and the radiation portion 112 and the radiation portion 113A) of the radiation conductor 110A is provided as the top surface portion, and the other of the two adjacent divided radiation portions is provided on the bottom surface. Specifically, in the present modification, the radiation portions 111A, 112, and 113A are alternately provided as the top surface portion and the bottom surface portion in an alignment order with respect to the first feeding point PS1. As described above, one end portions of the radiation portions 111A and 113A provided as bottom surface portions are, for example, integrally provided with the bottom surface electrodes 131 and 134, respectively. Additionally, no through-conductors are provided at the positions of the end portions.

Here, when focusing on the radiation portions 112 and 113A, the radiation portion 113A defining the bottom surface portion is provided at a position farther from the first feeding point PS1 than the radiation portion 112 defining the top surface portion. That is, the radiation portion 113A used for a band on lower frequency side is sandwiched by the antenna board AB and the motherboard MB.

Additionally, in the present modification, a connection wire 111B is provided on a top surface of the antenna board AB, one end portion thereof is connected to the first feeding point PS1, and the other end portion is connected to the impedance element 120 with a through-conductor 121A and a wire of the motherboard MB interposed therebetween. As described above, by providing the connection wire 111B and the through-conductor 121A, the impedance element 120 mounted on the motherboard MB may preferably be provided on the connection path between the first feeding point PS1 and the radiation conductor 110A.

Hereinafter, configurations of the antenna unit 100A including the antenna element ANT2 will be described together with a configuration of the motherboard MB.

Figure 8:
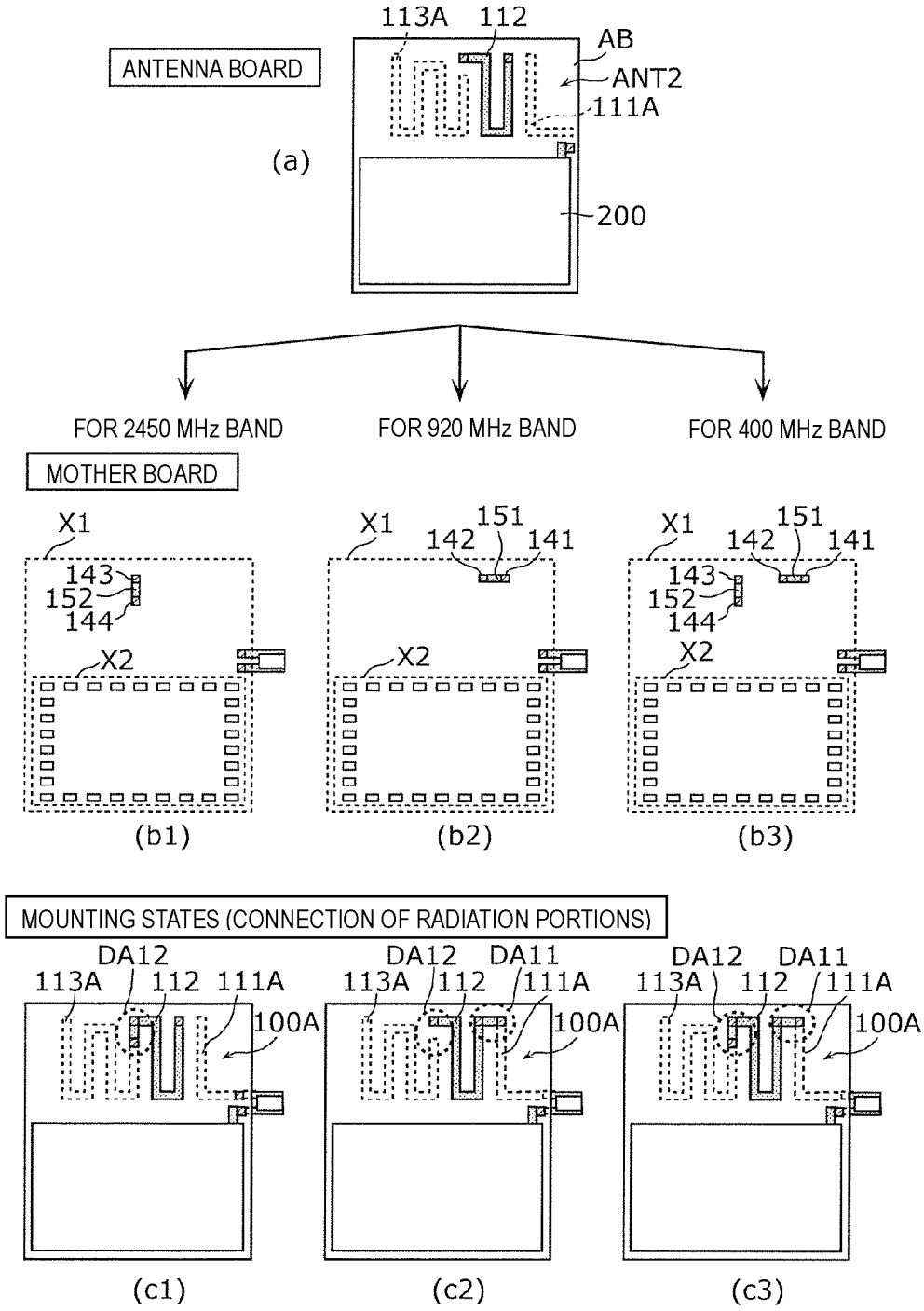
FIG. 8 is a diagram illustrating modes of use of the antenna element according to Modification 1 of Preferred Embodiment 1 of the present invention.

FIG. 8 is a diagram illustrating modes of use of the antenna element ANT2 according to the present modification, and illustrates modes of use in multiple bands. Specifically, FIG. 8 is a diagram schematically illustrating configurations to obtain, using the antenna element ANT2 in common illustrated in (a), the antenna units 100A for a 2450 MHz band, a 920 MHz band, and a 400 MHz band.

As illustrated in (b1) of FIG. 8, when the antenna element ANT2 is used for the 2450 MHz band, the two top surface electrodes 143, 144 and the connection wire 152 are provided on the motherboard MB. Accordingly, as illustrated in (c1) of FIG. 8, when the antenna board AB is mounted on the motherboard MB, the two radiation portions 112 and 113A are connected to each other with the connection wire 152 interposed therebetween. At this time, both of the two radiation portions 112 and 113A are radiation portions that are not fed with a signal from the first feeding point PS1. That is, in the present modification, the antenna unit 100A operates in the 2450 MHz band corresponding to a length of the radiation portion 111A in a state that the unpowered radiation portions 112 and 113B are connected to each other.

Configurations of the motherboard MB and the antenna unit 100A in cases in which the antenna element ANT2 illustrated in (b2), (b3), (c2), and (c3) of FIG. 8 is used for the 920 MHz band and the 400 MHz band, respectively, are similar to the configurations in Preferred Embodiment 1 illustrated in (b2), (b3), (c2), and (c3) of FIG. 5, thus descriptions thereof will be omitted.

Even the antenna element ANT2 configured as described above according to the present modification obtains advantageous effects the same as or similar to the Preferred Embodiment 1. That is, by providing the through-conductors 122, 123 and the bottom surface electrodes 132 and 133 at positions of end portions of the top surface portion (the radiation portion 112 in the present modification) of the radiation conductor 110A including the multiple radiation portions 111A, 112, and 113A, it is possible to support the multiple frequency bands while reducing the size of the antenna element ANT2.

Additionally, with the antenna element ANT2 according to the present modification, one of two adjacent radiation portions is provided on a top surface of the antenna board AB and the other of the two adjacent radiation portions is provided on a bottom surface, thus making it possible to reduce coupling between the two radiation portions. That is, when the one of the two radiation portions is used and the other thereof is not used, it is possible to reduce unnecessary coupling so as to reduce unnecessary radiation.

Additionally, with the antenna element ANT2 according to the present modification, since the bottom surface portion is provided at the position farther from the first feeding point PS1 than the top surface portion, the bottom surface portion becomes a radiation portion that is not used when a signal in a higher frequency band is radiated, and is used when a signal in a lower frequency band is radiated. Since the bottom surface portion is sandwiched between the antenna board AB and the motherboard MB, an effective dielectric constant thereof is higher as compared to the top surface portion. That is, in the antenna element, the effective dielectric constant is high in a radiation portion which tends to increase in size in a propagation direction in order to radiate a signal in the lower frequency band. Thus, by reducing or preventing an increase in size of the radiation portion, the antenna element is further reduced in size as a whole.

Additionally, with the antenna unit 100A according to the present modification, the two radiation portions (the radiation portion 112 and the radiation portion 113A in the present modification) not being fed with a signal are connected to each other, thus making it possible to separate resonant frequencies of the two radiation portions from an operating frequency of the radiation conductor 110A. Thus, deterioration of characteristics of the antenna element ANT2 is reduced or prevented.

Particularly, in the present modification, since lengths of the radiation portion 111A and the radiation portion 112 are the same or substantially the same, resonant frequencies of these radiation portions are relatively close to one another. Accordingly, when the radiation portion 111A is used and the radiation portion 112 is not used, unnecessary resonance may be caused in some cases. Thus, by connecting the radiation portion 112 and the radiation portion 113A, it is possible to separate the resonant frequencies of the radiation portion 112 and the radiation portion 113A from a frequency used, in order to reduce or prevent generation of unnecessary resonance.

Additionally, with the antenna unit 100A according to the present modification, the impedance element 120 is provided on the motherboard MB, thus making it possible to appropriately adjust a constant of the impedance element 120 in accordance with an operating frequency among the multiple frequency bands. Thus, characteristics of the antenna unit 100A are improved or optimized. Additionally, the characteristics may be improved or optimized without adjusting the constant on a side of the antenna element ANT2. That is, it is possible to eliminate a need to change a constant of the impedance element 120, which is possibly changed depending on a band used, optimization in a mounted state, or other factors, at a manufacturing stage of the antenna element ANT2. Accordingly, design efficiency and manufacturing efficiency of the antenna element ANT2 are improved.

Modification 2 of Preferred Embodiment 1

Although in Preferred Embodiment 1 and Modification 1 thereof, the antenna elements are configured to support three bands, it is sufficient that the antenna elements are configured to support two or more bands, and, for example, the antenna elements may preferably be configured to support four or more bands. Accordingly, hereinafter, a communication module 10B according to Modification 2 of Preferred Embodiment 1 will be described using a communication module including the antenna element as an example. Note that, in the present modification, since a functional configuration of the communication module 10B is similar to that of Preferred Embodiment 1, description thereof is omitted.

Figure 9:
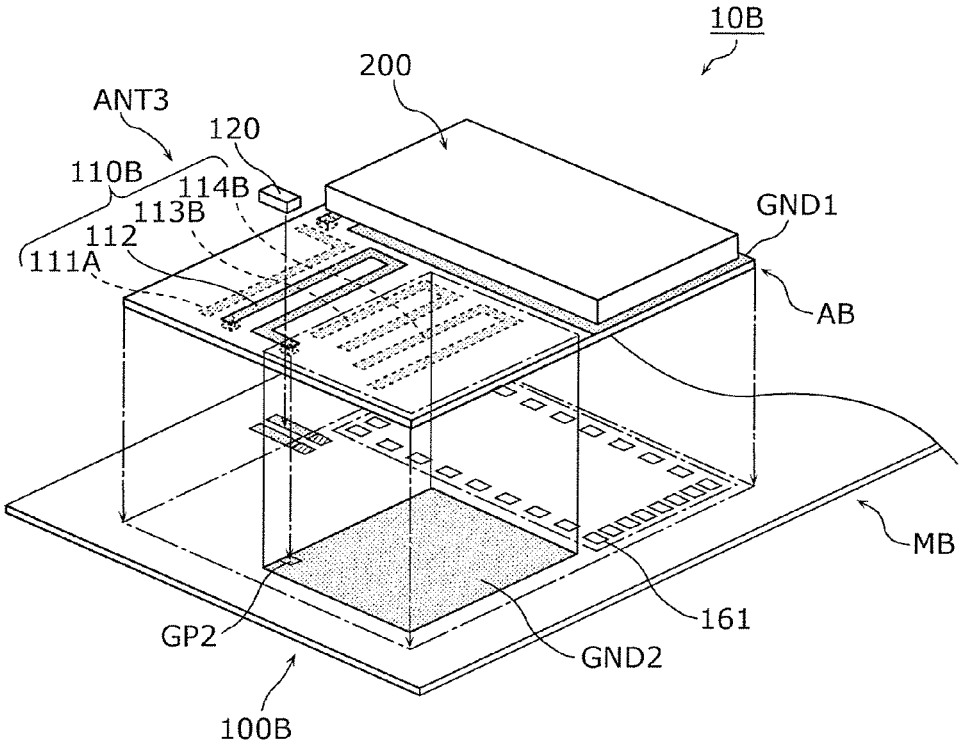
FIG. 9 is a diagram illustrating an exemplary configuration of an antenna unit according to Modification 2 of Preferred Embodiment 1 of the present invention.
Figure 10:
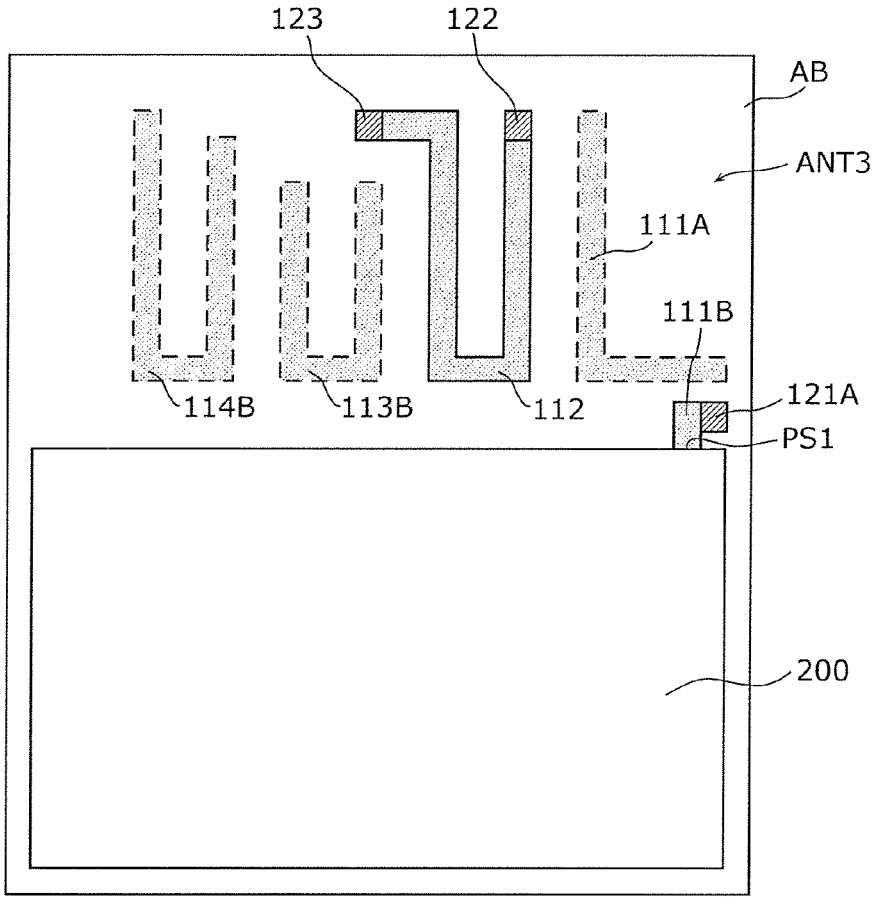
FIG. 10 is a top view of an antenna element according to Modification 2 of Preferred Embodiment 1 of the present invention.

FIG. 9 is a diagram illustrating an exemplary configuration of an antenna unit 100B according to Modification 2 of Preferred Embodiment 1. Specifically, FIG. 9 is a perspective view of the antenna unit 100B. FIG. 10 is a top view of the antenna unit 100B according to Modification 2 of Preferred Embodiment 1.

The antenna unit 100B illustrated in the above-described figures, for example, includes an antenna element ANT3 configured to be capable of supporting four bands including a 2450 MHz band and three sub-GHz bands (here, a 920 MHz band, an 870 MHz band, and a 400 MHz band). That is, the antenna unit 100B is preferably configured, for example, to support a European 870 MHz band (an 868 MHz to 870 MHz band) as well. In FIG. 9, a configuration corresponding to the 2450 MHz band among the four bands is illustrated. Note that, a band that the antenna element ANT3 is capable of supporting is not limited thereto, and, for example, the antenna element ANT3 may be capable of supporting the 2450 MHz band, and sub-GHz bands other than the above-described sub-GHz bands.

Specifically, the antenna element ANT3 according to the present modification includes a radiation conductor 110B including four radiation portions including the radiation portions 111A, 112, 113B, and a radiation portion 114B, instead of the radiation conductor 110A according to Modification 1 of Preferred Embodiment 1 including the three radiation portions 111A, 112, and 113A.

Here, each of the radiation portions 113B and 114B has a shape in which a portion of the radiation portion 113A illustrated in FIG. 6 and FIG. 7 is cut off. Since an additionally required radiation portion for operation in the 870 MHz band is shorter than operation in the 920 MHz band, when a radiation conductor is divided on the antenna board AB as in Preferred Embodiment 1 and Modification 1 thereof, there is a risk that an open end of the radiation portion faces a direction in which a next radiation portion is positioned and faces a direction in which the ground electrode GND1 is positioned, and unnecessary radiation is caused. Accordingly, in the present modification, a radiation portion additionally required for operation in the 870 MHz band is extended on the motherboard MB. Further, portions of the radiation portions 113B and 114B are cut off so as not to interfere with a radiation portion on the motherboard MB, and the radiation portions 113B and 114B are to be connected to each other on the motherboard MB when operating in the 400 MHz band.

Hereinafter, configurations of the antenna unit 100B including the antenna element ANT3 will be described together with a configuration of the motherboard MB.

Figure 11A:
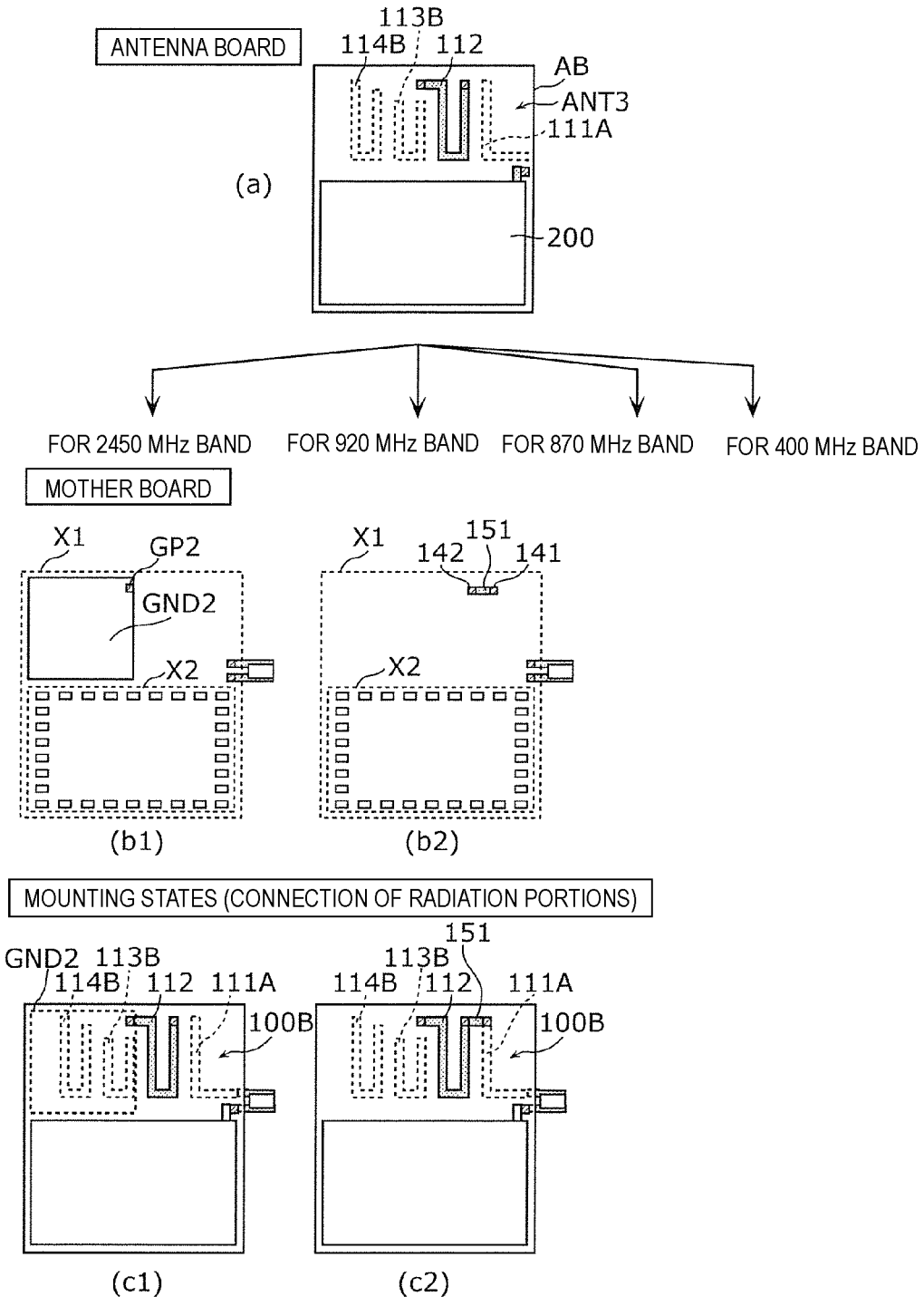
FIG. 11A is a diagram illustrating modes of use of the antenna element according to Modification 2 of Preferred Embodiment 1 of the present invention.
Figure 11B:
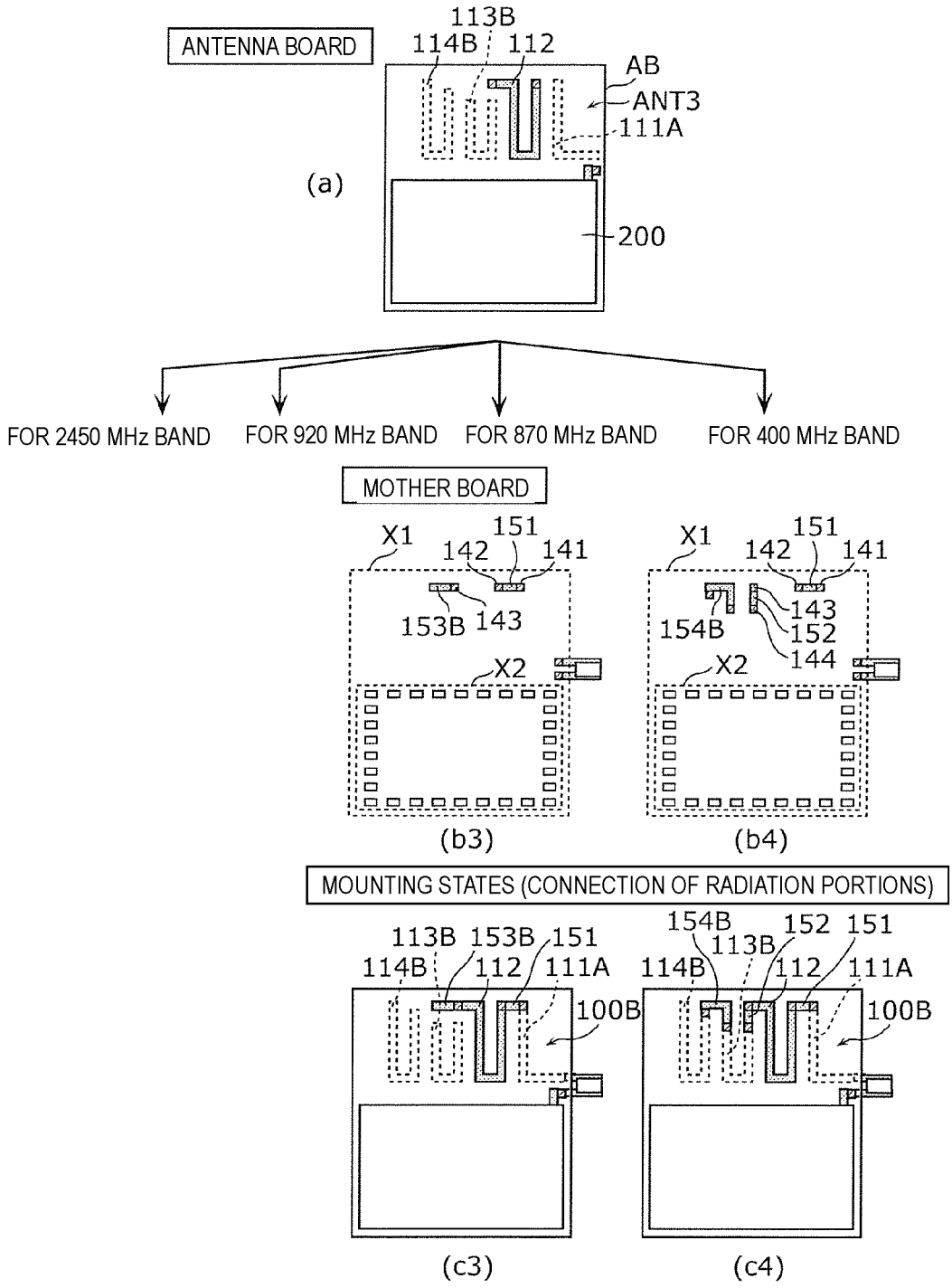
FIG. 11B is a diagram illustrating modes of use of the antenna element according to Modification 2 of Preferred Embodiment 1 of the present invention.

FIGS. 11A and 11B are diagrams illustrating modes of use of the antenna element ANT3 according to the present modification, and illustrate modes of use in respective multiple bands. Specifically, these figures are diagrams schematically illustrating configurations to obtain the antenna units 100B for the 2450 MHz band, the 920 MHz band, the 870 MHz band, and the 400 MHz band using the antenna element ANT3 in common illustrated in (a).

As illustrated in (b1) of FIG. 11A, when the antenna element ANT3 is used for the 2450 MHz band, a ground pad GP2 and a ground electrode GND2 are provided on the motherboard MB.

Here, the radiation conductor 110B includes two adjacent divided radiation portions, one radiation portion of which is fed with a signal from the first feeding point PS1 and the other radiation portion of which is not fed with a signal from the first feeding point PS1. Here, the radiation portions 111A and 112 correspond to the two radiation portions, the radiation portion 111A is configured to be fed with a signal from the first feeding point PS1, and the radiation portion 112 is configured not to be fed with a signal from the first feeding point PS1.

The ground pad GP2 is a second ground electrode provided on a top surface of the motherboard MB so as to face an end portion of the other radiation portion (the radiation portion 112 in the present preferred embodiment), and connected to the end portion with the conductive bonding material 130 interposed therebetween. In the present preferred embodiment, the ground pad GP2 is provided so as to face an end portion of the radiation portion 112 on a side opposite the radiation portion 111A.

The ground electrode GND2 is a third ground electrode provided on the top surface of the motherboard MB so as to cover at least one radiation portion not being fed with a signal from the first feeding point PS1 of the radiation conductor 110B. In the present preferred embodiment, the ground electrode GND2 preferably covers the radiation portions 113B and 114B. Note that, although the ground electrode GND2 is preferably provided so as to cover all of the radiation portions 113B and 114B, the ground electrode GND2 may be provided so as to cover at least a portion thereof.

Note that, although respective materials of the ground pad GP2 and the ground electrode GND2 are not specifically limited as long as the materials are conductive materials, for example, materials similar to the radiation conductor 110, the through-conductors 121 to 124, the bottom surface electrodes 131 to 134, and the ground electrode GND1 may preferably be used.

With the above-described configuration, as illustrated in (c1) of FIG. 11A, when the antenna board AB is mounted on the motherboard MB, the radiation portion 111A becomes a powered conductor, and the radiation portion 112 adjacent to the radiation portion 111A becomes an unpowered radiation conductor. Additionally, the radiation portions 113B and 114B are covered with the ground electrode GND2.

Configurations of the motherboard MB and the antenna unit 100B when the antenna element ANT3 illustrated in (b2) and (c2) of FIG. 11A is used for the 920 MHz band are similar to the configurations in Preferred Embodiment 1 illustrated in (b2), (c2) of FIG. 5, thus descriptions thereof will be omitted.

As illustrated in (b3) of FIG. 11B, when the antenna element ANT3 is used for the 870 MHz band, the top surface electrode 143 and a connection wire 153B are additionally provided on the motherboard MB, compared to a case in which the antenna element ANT3 illustrated in (b2) of FIG. 11A is used for the 920 MHz band.

The connection wire 153B is a pattern wire including one end portion thereof connected to the top surface electrode 143 and the other end portion thereof not connected to any conductive materials. That is, the other end portion of the connection wire 153B is an open end. The connection wire 153B is configured such that when connected to the radiation portions 111A and 112 of the antenna element ANT3, a total length thereof is equal or substantially equal to an electrical length of a substantially ¼ wave length in the 870 MHz band.

With the above-described configuration, as illustrated in (c3) of FIG. 11B, when the antenna board AB is mounted on the motherboard MB, the radiation portions 111A, 112 and the connection wire 153B are connected to each other with the connection wire 151 interposed therebetween. Thus, the antenna unit 100B operates in the 870 MHz band corresponding to the length of the radiation portions 111A, 112 and the connection wire 153B.

As illustrated in (b4) of FIG. 11B, when the antenna element ANT3 is used for the 400 MHz band, the connection wire 153B is not provided, and the connection wire 152 and the top surface electrode 144 are provided as in Preferred Embodiment 1, compared to the case in which the antenna element ANT3 illustrated in (b3) of FIG. 11B is used for the 870 MHz band. Additionally, a connection wire 154B and two top surface electrodes connecting the radiation portion 113B to the radiation portion 114B are further provided on the motherboard MB.

With the above-described configuration, as illustrated in (c4) of FIG. 11B, when the antenna board AB is mounted on the motherboard MB, the radiation portions 111A, 112, 113B, and 114B are connected to each other with the connection wires 151, 152 and 154B interposed therebetween. Thus, the antenna unit 100B operates in the 400 MHz band corresponding to the length of the radiation portions 111A, 112, 113B, and 114B.

The antenna element ANT3 configured as described above according to the present modification obtains advantageous effects the same as or similar to Preferred Embodiment 1. That is, by providing the through-conductors 122, 123 and the bottom surface electrodes 132 and 133 at positions of end portions of a top surface portion (the radiation portion 112 in the present modification) of the radiation conductor 110B including the multiple radiation portions 111A, 112, 113B, and 114B it is possible to support multiple frequency bands while reducing the size of the antenna element ANT3.

Additionally, with the antenna unit 100B according to the present modification, by connecting the radiation portion 112 adjacent to the radiation portion 111A being fed with a signal from the first feeding point PS1 to the second ground electrode (the ground pad GP2 in the present modification), the radiation portion 112 becomes an unpowered element. That is, the radiation portion 112 also has an antenna function, thus enabling the antenna unit 100B to have a wider band.

Figure 12:
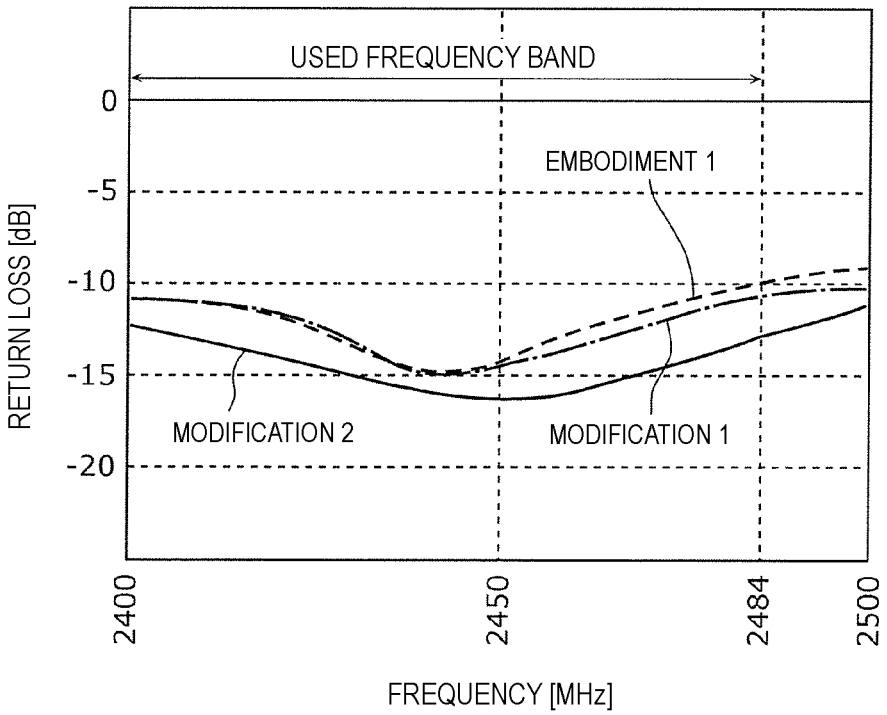
FIG. 12 is a diagram showing performance of the antenna unit according to Modification 2 of Preferred Embodiment 1 of the present invention.

FIG. 12 is a graph showing performance of the antenna unit 100B according to the present modification, a horizontal axis shows frequency, and a vertical axis shows return loss. As shown in FIG. 12, the return loss in the present modification ("MODIFICATION 2" in the figure) is improved as a whole as compared to Preferred Embodiment 1 and Modification 1 of Preferred Embodiment 1 ("MODIFICATION 1" in the figure). That is, in the present modification, a band width is widened.

Note that, not only does the antenna unit 100B have a wider band but also another performance, such as directivity may be adjusted by appropriately designing the antenna unit 100B.

Additionally, with the antenna unit 100B according to the present modification, the third ground electrode (the ground electrode GND2 in the present modification) is provided so as to cover the radiation portion not being fed with a signal (the radiation portions 113B and 114B in the present modification), thus making it possible to reduce unnecessary coupling between a non-radiating radiation portion and a radiating radiation portion among multiple radiation portions defining the radiation conductor 110B. Thus, unnecessary radiation may be further reduced.

Preferred Embodiment 2

In the above-described Preferred Embodiment 1 and the modifications thereof, the antenna elements capable of supporting the multiple bands while reducing the size of the antenna elements have been described, using the antenna element being fed with a signal from one feeding point as an example. However, the above-described technique is applicable to an antenna element being fed with a signal from multiple feeding points. Accordingly, a communication module 10C according to Preferred Embodiment 2 will be described using a communication module including such antenna element as an example.

Figure 13:
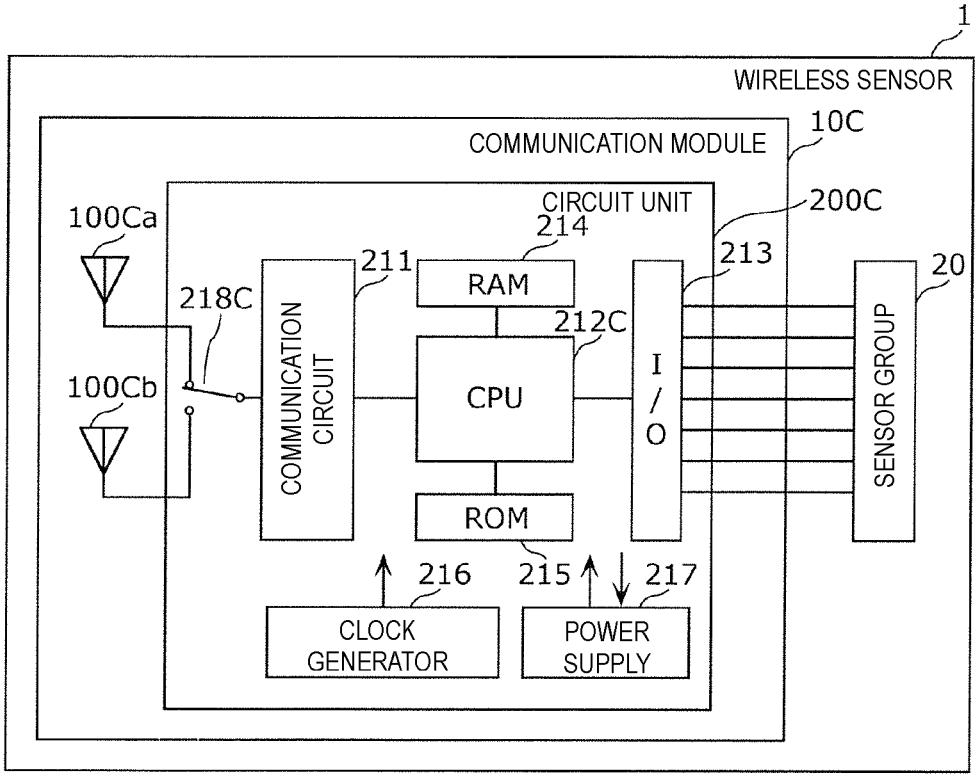
FIG. 13 is a block diagram illustrating a functional configuration of a wireless sensor including a communication module according to Preferred Embodiment 2 of the present invention.

FIG. 13 is a block diagram illustrating a configuration of the wireless sensor 1 including the communication module 10C according to the present preferred embodiment.

The communication module 10C is capable of performing an antenna diversity operation (hereinafter, a diversity operation), and, for example, performs the diversity operation with a 2450 MHz band. The communication module 10C is different from the communication module 10 in FIG. 2 in that the communication module 10C includes multiple (here, two) antenna units 100Ca and 100Cb, and is different in the configuration of a circuit unit 200C.

The circuit unit 200C includes, as compared to the circuit unit 200 in FIG. 2, a CPU 212C capable of controlling the diversity operation, instead of the CPU 212. Additionally, a switch 218C for selectively connecting one of the antenna units 100Ca and 100Cb to the circuit unit 200C in accordance with control by the CPU 212C is included.

Figure 14:
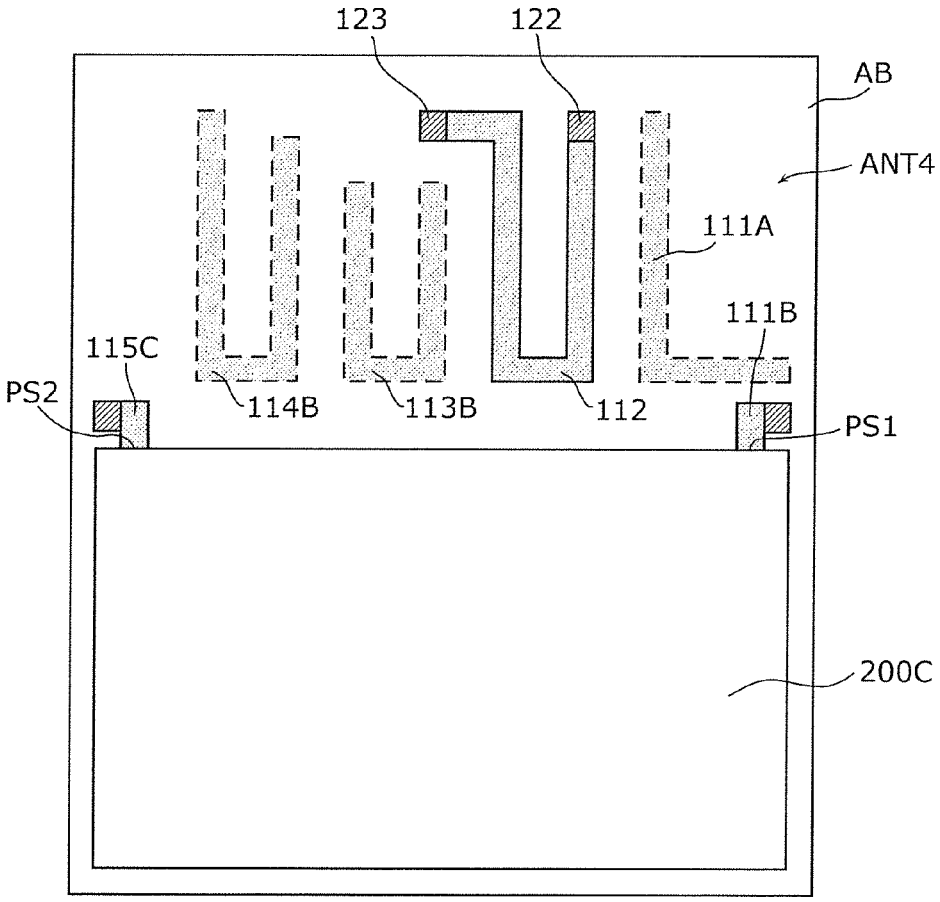
FIG. 14 is a top view of an antenna element according to Preferred Embodiment 2 of the present invention.

FIG. 14 is a top view of an antenna element ANT4 according to Preferred Embodiment 2.

The antenna element ANT4 illustrated in FIG. 14, in comparison with the antenna element ANT3 illustrated in FIG. 10, further includes a second feeding point PS2, and a connection wire 115C for connecting the radiation conductor 110B (see FIG. 10) to the second feeding point PS2. Here, the second feeding point PS2 is used when the diversity operation is performed in the communication module 10C illustrated in FIG. 13.

Hereinafter, configurations of the antenna units 100Ca and 100Cb using the antenna element ANT4 in common will be described together with a configuration of the motherboard MB. Note that, in the present preferred embodiment, portions each having an antenna function when the diversity operation is performed with the 2450 MHz band are described as the antenna units 100Ca and 100Cb, respectively, for convenience. However, these portions may be configured as an integral antenna unit, and a portion of the antenna unit may correspond to the antenna unit 100Ca, and another portion may correspond to the antenna unit 100Cb.

Figure 15:
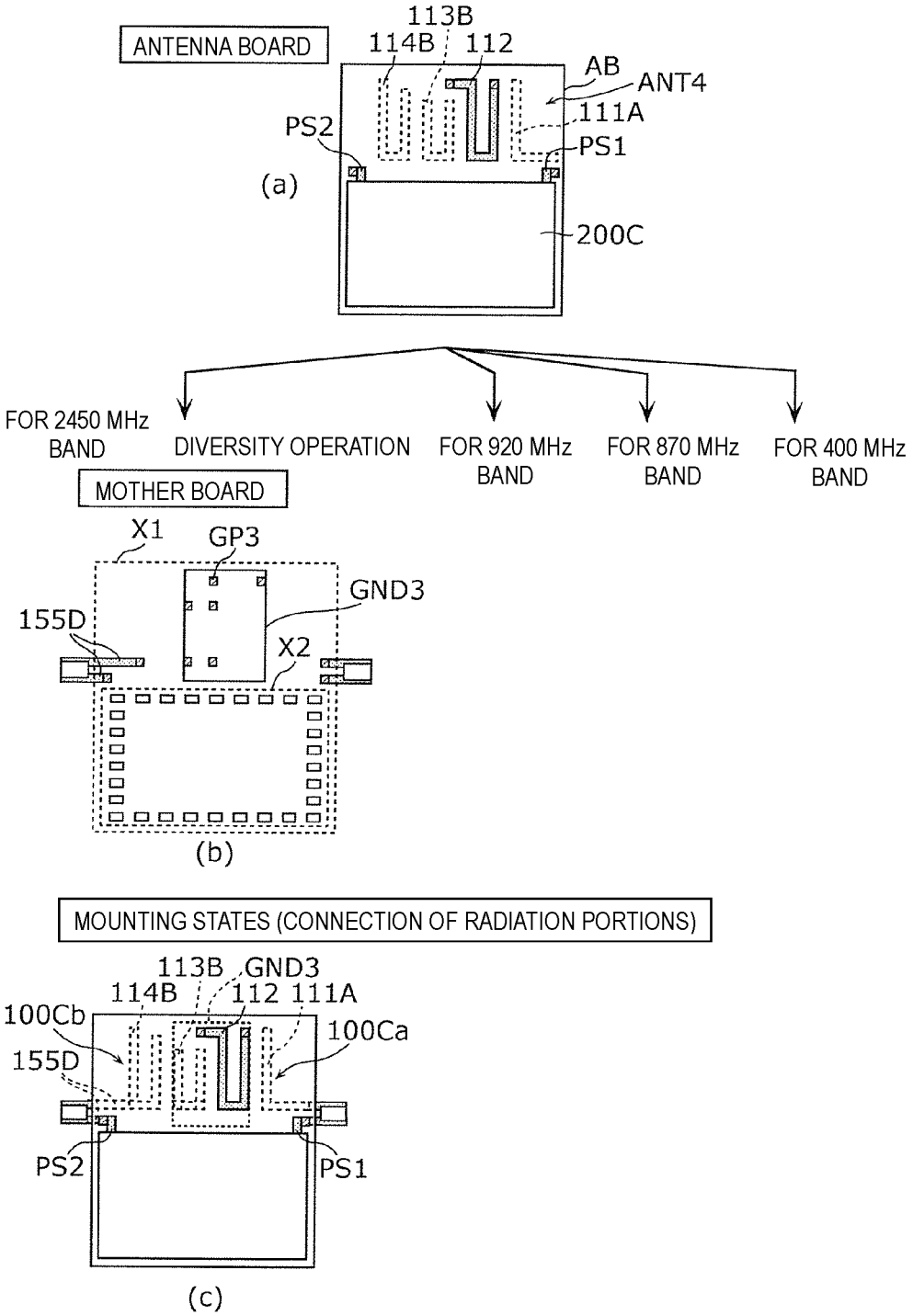
FIG. 15 is a diagram illustrating modes of use of the antenna element according to Preferred Embodiment 2 of the present invention.

FIG. 15 is a diagram illustrating modes of use of the antenna element ANT4 according to the present preferred embodiment. Specifically, FIG. 15 is a diagram schematically illustrating a configuration to realize the antenna units 100Ca and 100Cb to performing the diversity operation in the 2450 MHz band using the antenna element ANT4 in common illustrated in (a). Note that, in the present preferred embodiment, since modes of use in sub-GHz bands (a 920 MHz band, an 870 MHz band, and a 400 MHz band) are similar to FIG. 11A and FIG. 11B, illustrations thereof are omitted.

As illustrated in (b) of FIG. 15, when the antenna element ANT4 is used for the 2450 MHz band, a connection wire 155D is provided on the motherboard MB. Additionally, in the present preferred embodiment, a ground pad GP3 and the ground electrode GND3 are further provided.

The connection wire 155D is a wire provided on the motherboard MB and connecting the second feeding point PS2 different from the first feeding point PS1 and the radiation conductor 110B. In the present preferred embodiment, an end portion of the connection wire 155D is arranged so as to face a substantially middle point of the radiation portion 114B.

The ground pad GP3 is provided on a top surface of the motherboard MB so as to face end portions, or the like, of the radiation portions 112 and 113B, of the radiation conductor 110B, not connected to any of the first feeding point PS1 and the second feeding point PS2, and is connected to the end portions, or the like, with the conductive bonding material 130 interposed therebetween.

A ground electrode GND3 is provided on the top surface of the motherboard MB so as to cover the radiation portions 112 and 113B, of the radiation conductor 110B, not connected to any of the first feeding point PS1 and the second feeding point PS2. Note that, although the ground electrode GND3 is preferably provided so as to cover all of the radiation portions 112 and 113B, the ground electrode GND3 may be provided so as to cover at least a portion thereof.

With the above-described configuration, as illustrated in (c) of FIG. 15, when the antenna board AB is mounted on the motherboard MB, the radiation conductor 110B is connected as follows. That is, in the radiation conductor 110B, a first group including at least one radiation portion (the single radiation portion 111A in the present preferred embodiment) of the multiple radiation portions 111A, 112, 113B, and 114B is connected to the first feeding point PS1, and is not connected to the second feeding point PS2. Additionally, in the radiation conductor 110B, a second group including at least one other radiation portion (the single radiation portion 114B in the present preferred embodiment) of the multiple radiation portions is not connected to the first feeding point PS1, and is connected to the second feeding point PS2. That is, in the present preferred embodiment, the antenna unit 100Ca includes the radiation portion 111A of the first group of the antenna element ANT4 and the motherboard MB, and the antenna unit 100Cb includes the radiation portion 114B of the second group of the antenna element ANT4 and the motherboard MB.

That is, the antenna unit 100Ca and the antenna unit 100Cb perform the antenna diversity operation using the above-described first group and the second group by selectively feeding a signal in at least one frequency band (here, the 2450 MHz band) among the multiple frequency bands to one of the first feeding point PS1 and the second feeding point PS2.

The antenna element ANT4 configured as described above according to the present preferred embodiment is also capable of exhibiting effects similar to the above-described Preferred Embodiment 1.

Additionally, according to the antenna units 100Ca and 100Cb of the present preferred embodiment, since the first group (the single radiation portion 111A in the present preferred embodiment) is connected to the first feeding point PS1 and the second group (the single radiation portion 114B in the present preferred embodiment) is connected to the second feeding point PS2, switching between various operations of the antenna units 100Ca and 100Cb may be performed.

Specifically, according to the antenna units 100Ca and 100Cb of the present preferred embodiment, by performing the antenna diversity operation using the first group and the second group, characteristics deterioration in a higher frequency band in which the characteristics deterioration tends to particularly increase due to phasing or directivity may be reduced.

Additionally, with the antenna units 100Ca and 100Cb according to the present preferred embodiment, the ground pad GP3 to be connected to the radiation portions 112 and 113B not used for the 2450 MHz band is provided. Accordingly, coupling between both branches (the radiation portion 111A and the radiation portion 114B) performing the diversity operation is reduced or prevented.

Note that, in the present preferred embodiment, although the antenna units 100Ca and 100Cb are described using the diversity operation as an example, when a communication circuit using the antenna units 100Ca and 100Cb supports MIMO, the antenna units 100Ca and 100Cb may be controlled to perform a MIMO operation. That is, the antenna units 100Ca and 100Cb may perform the MIMO operation using the first group and the second group by feeding a signal in at least one frequency band among the multiple frequency bands to both of the first feeding point PS1 and the second feeding point PS2.

As described above, by performing the MIMO operation using the first group and the second group, it is possible to increase transmission capacity while reducing the characteristics deterioration in the higher frequency band in which the characteristics deterioration tends to particularly increase due to the phasing or the directivity.

Additionally, as described in Modification 2 of Preferred Embodiment 1, the radiation portions 113B and 114B are not used for the 920 MHz band and an 870 MHz band. Accordingly, the motherboard MB may be designed such that, when the antenna element ANT4 is used for the 920 MHz band or the 870 MHz band, the first feeding point PS1 is connected to the radiation portions 111A and 112, and when used for the 2450 MHz band, the second feeding point PS2 is connected to the radiation portion 114B.

That is, in the antenna units, the first group (here, the radiation portions 111A and 112) and the second group (here, the radiation portion 114B) may transmit or receive respective signals having frequency bands different from each other, by feeding a signal in one frequency band (here, the 920 MHz band and the 870 MHz band) among the multiple frequency bands to the first feeding point PS1, and feeding a signal in another frequency band (here, the 2450 MHz band) to the second feeding point PS2.

Accordingly, when a wireless system to which the antenna element ANT4 is applied supports multiple bands, the single antenna element ANT4 or a communication module may be used to make the wireless system operate for different frequency bands.

Further, in the above-described configuration, it is possible to improve radiation characteristics by designing the radiation portion 113B to have an appropriate length and using the radiation portion 113B as an unpowered radiation conductor.

Additionally, in the above-described configuration, the first group and the second group may transmit or receive simultaneously. Accordingly, the antenna units are capable of supporting carrier aggregation for a communication system, such as a wireless module, for example.

The antenna elements, the antenna units, and the communication modules of the preferred embodiments and the modifications thereof according to the present invention have been described. However, the present invention is not limited to the individual preferred embodiments and the modifications thereof. Variations of these preferred embodiments and modifications thereof conceived of by those skilled in the art, preferred embodiments by combining elements from different preferred embodiments and modifications thereof, and so on are included in the scope of the present invention as long as they do not depart from the gist of the present invention.

For example, a radiation conductor is not required to have a meandering shape, for example, and may be provided as a spiral shape, or a rectangular or substantially rectangular plane shape, for example.

Additionally, for example, an end portion of a radiation portion on a side of the first feeding point PS1 of two adjacent radiation portions may face an end portion of the other of the two adjacent radiation portions. However, from a viewpoint of reducing unnecessary radiation, the end portion of the radiation portion on the first feeding point PS1 side preferably does not face the end portion of the other radiation portion, and additionally, the end portion of the radiation portion on the first feeding point PS1 side preferably does not face any portion of the other radiation portion.

Additionally, for example, a radiation conductor may be divided at a position different from a side opposite a first ground electrode (the ground electrode GND1 in the description above).

Preferred embodiments of the present invention may be widely utilized for wireless equipment, such as a wireless sensor, as a compact and versatile antenna element, antenna unit, and communication module, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna element to be mounted on a motherboard, the antenna element comprising:

a board;

a radiation conductor including a plurality of radiation portions including a top surface portion provided on a top surface of the board, the plurality of radiation portions being divided at positions corresponding to multiple frequency bands and provided with respect to a first feeding point in plan view of the board;

a through-conductor penetrating the board at a position of an end portion of the top surface portion in a thickness direction of the board; and a bottom surface electrode provided on a bottom surface of the board opposite the end portion of the top surface portion, and connected to the top surface portion via the through-conductor; wherein the bottom surface electrode is structured to be connected to a top surface electrode on the motherboard.

2. The antenna element according to claim 1, wherein in the radiation conductor, in the plan view, an end portion of a radiation portion, on a side of the first feeding point, of two adjacent divided radiation portions of the plurality of radiation portions does not face an end portion of another of the two adjacent divided radiation portions.

3. The antenna element according to claim 1, wherein in the radiation conductor, each of two adjacent divided radiation portions of the plurality of radiation portions is provided as the top surface portion; and the through-conductor and the bottom surface electrode are provided to correspond to each of mutually divided end portions of the two adjacent divided radiation portions.

4. The antenna element according to claim 1, wherein one of two adjacent divided radiation portions of the plurality of radiation portions in the radiation conductor is provided as the top surface portion, and another of the two adjacent divided radiation portions is provided on a bottom surface of the board.

5. The antenna element according to claim 1, wherein the radiation conductor includes a bottom surface portion provided on the bottom surface of the board; and the bottom surface portion is provided at a position farther from the first feeding point than the top surface portion.

6. The antenna element according to claim 1, further comprising:

a first ground electrode adjacent to the radiation conductor in a lateral direction on the board; wherein the radiation conductor is divided and provided on a side opposite to the first ground electrode in the plan view.

7. An antenna unit, comprising:

the antenna element according to claim 1;

a motherboard on a top surface of which the antenna element is mounted by a conductive bonding material; and two top surface electrodes provided at positions on the top surface of the motherboard facing respective end portions of two adjacent divided radiation portions of the radiation conductor, and connected to the respective end portions via the conductive bonding material.

8. The antenna unit according to claim 7, wherein the two adjacent divided radiation portions are not fed with a signal from the first feeding point.

9. The antenna unit according to claim 7, wherein one of the two adjacent divided radiation portions is fed with a signal from the first feeding point without another of the two adjacent divided radiation portions being interposed therebetween; and the another of the two adjacent divided radiation portions is fed with a signal from the first feeding point with the one of the two adjacent divided radiation portions being interposed therebetween.

10. The antenna unit according to claim 7, wherein one of the two adjacent divided radiator portions is fed with a signal from the first feeding point and another of the two adjacent divided radiator portions is not fed with a signal from the first feeding point; and the antenna unit further includes a second ground electrode provided on the top surface of the motherboard to face an end portion of the another of the two adjacent divided radiation portions, and connected to the end portion with the conductive bonding material interposed therebetween.

11. The antenna unit according to claim 7, further comprising:

a third ground electrode provided on the top surface of the motherboard to cover at least one radiation portion of the plurality of radiation portions not being fed with a signal from the first feeding point of the radiation conductor.

12. The antenna unit according to claim 7, further comprising:

an impedance element that performs frequency adjustment provided on the motherboard and located on a connection path between the first feeding point and the radiation conductor.

13. The antenna unit according to claim 7, further comprising:

a wire provided on the motherboard and connecting the radiation conductor and a second feeding point different from the first feeding point; wherein in the radiation conductor:

a first group including at least one radiation portion of the plurality of radiation portions is connected to the first feeding point and is not connected to the second feeding point; and a second group including at least one other radiation portion of the plurality of radiation portions is not connected to the first feeding point and is connected to the second feeding point.

14. The antenna unit according to claim 13, wherein the antenna unit performs an antenna diversity operation using the first group and the second group by selectively feeding a signal in at least one frequency band among the multiple frequency bands to one of the first feeding point and the second feeding point.

15. The antenna unit according to claim 13, wherein the first group and the second group transmit or receive respective signals having frequency bands different from each other, by feeding a signal in one frequency band among the multiple frequency bands to the first feeding point, and feeding a signal in another frequency band to the second feeding point.

16. A communication module, comprising:

the antenna unit according to claim 7, and a communication circuit that performs communication using the antenna unit.

17. The communication module according to claim 16, wherein the two adjacent divided radiation portions are not fed with a signal from the first feeding point.

18. The communication module according to claim 16, wherein one of the two adjacent divided radiation portions is fed with a signal from the first feeding point without another of the two adjacent divided radiation portions being interposed therebetween; and the another of the two adjacent divided radiation portions is fed with a signal from the first feeding point with the one of the two adjacent divided radiation portions being interposed therebetween.

19. The communication module according to claim 16, wherein one of the two adjacent divided radiation portions is fed with a signal from the first feeding point and another of the two adjacent divided radiation portions is not fed with a signal from the first feeding point; and the antenna unit further includes a second ground electrode provided on the top surface of the motherboard to face an end portion of the another of the two adjacent divided radiation portions, and connected to the end portion with the conductive bonding material interposed therebetween.

20. The communication module according to claim 16, further comprising:

a third ground electrode provided on the top surface of the motherboard to cover at least one radiation portion of the plurality of radiation portions not being fed with a signal from the first feeding point of the radiation conductor.

* * * * *